US008086147B2

(12) United States Patent
Furuta et al.

(10) Patent No.: US 8,086,147 B2
(45) **Date of Patent: *Dec. 27, 2011**

(54) IMAGE FORMING APPARATUS AND INTERMEDIATE TRANSFER UNIT

(75) Inventors: Shinji Furuta, Osaka (JP); Koju Yamamoto, Osaka (JP); Hirokazu Fujii, Osaka (JP); Hiroki Morishita, Osaka (JP); Yoshiaki Ikebata, Osaka (JP)

(73) Assignee: Kyocera Mita Corporation (JP)

( * ) Notice: Subject to any disclaimer, the term of this patent is extended or adjusted under 35 U.S.C. 154(b) by 6 days.

This patent is subject to a terminal disclaimer.

(21) Appl. No.: 12/710,412

(22) Filed: Feb. 23, 2010

(65) Prior Publication Data

US 2010/0150613 A1 Jun. 17, 2010

Related U.S. Application Data

(62) Division of application No. 12/009,391, filed on Jan. 18, 2008, now Pat. No. 7,684,730.

(30) Foreign Application Priority Data

| | | |
|---|---|---|
| Jan. 18, 2007 | (JP) | 2007-009206 |
| Jan. 18, 2007 | (JP) | 2007-009275 |
| Jan. 23, 2007 | (JP) | 2007-012091 |
| Jan. 23, 2007 | (JP) | 2007-012172 |
| Jul. 11, 2007 | (JP) | 2007-182100 |
| Oct. 16, 2007 | (JP) | 2007-268604 |

(51) Int. Cl.
*G03G 15/08* (2006.01)
*G03G 15/01* (2006.01)

(52) U.S. Cl. ..... 399/258; 399/121; 399/224

(58) Field of Classification Search ..... 399/119, 399/121, 223, 224, 258, 297, 299
See application file for complete search history.

(56) References Cited

U.S. PATENT DOCUMENTS

| | | | | |
|---|---|---|---|---|
| 6,366,755 | B1 * | 4/2002 | Takashima | 399/254 |
| 7,062,207 | B2 | 6/2006 | Tsuda et al. | |
| 7,162,189 | B2 | 1/2007 | Tsuda et al. | |
| 7,257,349 | B2 | 8/2007 | Kitozaki | |
| 7,684,730 | B2 * | 3/2010 | Furuta et al. | 399/121 |
| 2005/0226656 | A1 | 10/2005 | Tsuda et al. | |

FOREIGN PATENT DOCUMENTS

| | | |
|---|---|---|
| JP | 2004-139031 | 5/2004 |

* cited by examiner

*Primary Examiner* — Sandra Brase
(74) *Attorney, Agent, or Firm* — Gerald E. Hespos; Michael J. Porco

(57) ABSTRACT

An intermediate transfer unit of an image forming apparatus is provided between a plurality of developer containers for containing developer and a plurality of developing devices. The intermediate transfer unit includes an intermediate transfer unit for secondarily transferring primarily transferred developed images from the plurality of image carriers onto a paper, an intermediate transfer unit driving mechanism for driving the intermediate transfer unit, and a housing for supporting the intermediate transfer unit driving mechanism. One end of the housing includes a plurality of developer inlet ports positionally corresponding to the developer supply ports of the developer containers respectively, a plurality of developer outlet ports positionally corresponding to the developer receiving ports of the developing devices respectively, and a plurality of developer supply paths connecting between the developer inlet ports and the developer outlet ports respectively.

10 Claims, 34 Drawing Sheets

IMAGE FORMING APPARATUS AND INTERMEDIATE TRANSFER UNIT

CROSS-REFERENCE TO RELATED APPLICATIONS

This application is a divisional of U.S. patent application Ser. No. 12/009,391 filed on Jan. 18, 2008.

BACKGROUND OF THE INVENTION

1. Field of the Invention

The present invention relates to an intermediate transfer unit for the secondary transfer onto sheet of developed images that were primarily transferred onto a plurality of image carriers, and an image forming apparatus comprising the intermediate transfer unit.

2. Description of the Related Art

In a conventional image forming apparatus having an intermediate transfer unit between a toner container for containing developer (toner) and a developing device, a toner supply pipe for supplying toner from the toner container to the developing device is provided such that the pipe detours around a housing of the intermediate transfer unit. Such an arrangement is disclosed in, for example, FIG. 7 of Japanese Unexamined Patent Publication No. 2004-139031.

FIG. 40 of this specification is a citation of FIG. 7 from the above patent document. As shown in FIG. 40, a setting space S between a toner container 32Y and a developing device 6Y is a space for setting the intermediate transfer unit (not shown). With this arrangement, a toner supply pipe 43Y for supplying toner from the toner container 32Y to the developing device 6Y is provided such that it detours and thus curves around the setting space S for the intermediate transfer unit. Since the toner supply pipe 43Y curves, a conveying member (not shown) such as a screw for conveying toner is provided inside the toner supply pipe 43Y.

However, the arrangement in the above patent document needs to provide a toner supply port of the toner container 32Y outside the developing device 6Y, which necessitates such a design that the toner container 32Y has a width larger than that of the developing device 6Y. This results in preventing size reduction of the image forming apparatus. An arrangement is also considered that the toner container 32Y is designed to have the same width as the developing device 6Y. However, the toner supply pipe 43Y must be provided such that it detours around the setting space S for the intermediate transfer unit even in such a case. Therefore, the image forming apparatus thus must be enlarged in its width direction according to that of the toner supply pipe 43Y, resulting in an image forming apparatus that cannot be made smaller. Further, when the toner supply pipe 43Y curves, there arises a necessity to provide the conveying member inside the toner supply pipe 43Y, which also limits down-sizing of the image forming apparatus since the toner supply pipe 43Y becomes larger.

In a color image forming apparatus comprising a plurality of sets of toner containers and developing devices, the task of connecting these toner containers and developing devices respectively to each other through toner supply pipes becomes necessary when manufacturing and maintaining the apparatus, which results in low productivity and inconvenient maintenance.

SUMMARY OF THE INVENTION

An object of the present invention is to provide an intermediate transfer unit that facilitates down-sizing of an image forming apparatus and improves productivity and ease of maintenance of the image forming apparatus, and an image forming apparatus comprising the intermediate transfer unit.

To achieve this object, an image forming apparatus relating to an aspect of the present invention comprises: a plurality of image carriers for carrying developed images; a plurality of developer containers for containing developer, each developer container having a developer supply port; a plurality of developing devices provided beneath the corresponding developer containers, each developing device having a developer receiving port; and an intermediate transfer unit arranged between the developer containers and the developing devices. The intermediate transfer unit includes secondarily transfers onto sheet primarily transferred developed images from the image carriers and includes an intermediate transfer unit drive mechanism for driving the intermediate transfer unit and a housing for supporting the intermediate transfer unit drive mechanism. One end of the housing is provided with a plurality of developer inlet ports each corresponding to each of the developer supply ports; a plurality of developer outlet ports each corresponding to each of the developer receiving ports; and a plurality of developer supply paths for connecting between the developer inlet ports and the developer outlet ports respectively.

DETAILED DESCRIPTION OF THE PREFERRED EMBODIMENTS

Some embodiments of the present invention will now be described below with reference to the accompanying drawings.

First Embodiment

Figure 1:
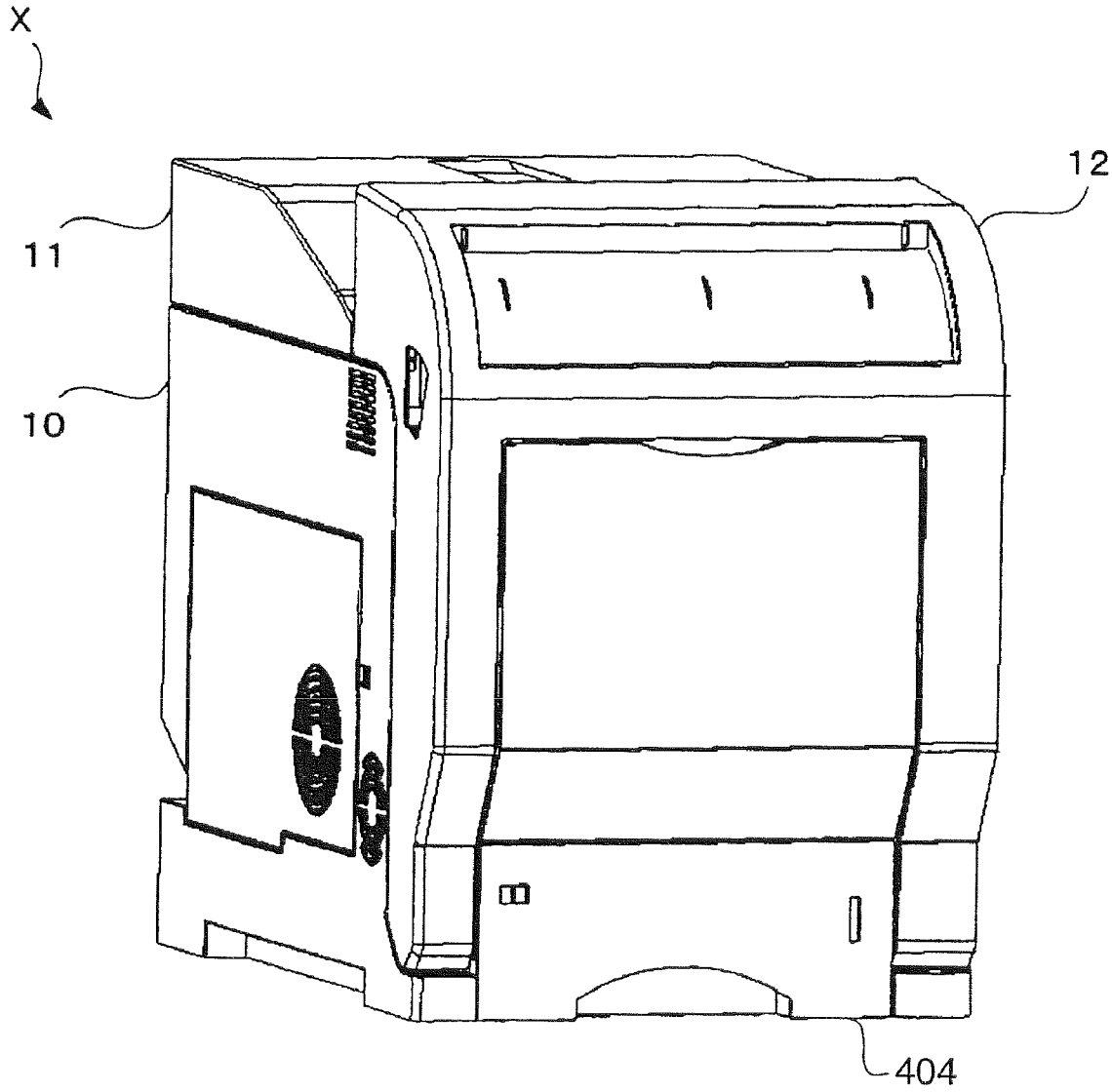
FIG. 1 is an exterior perspective view of a color printer according to a first embodiment of an image forming apparatus of the present invention.
Figure 2:
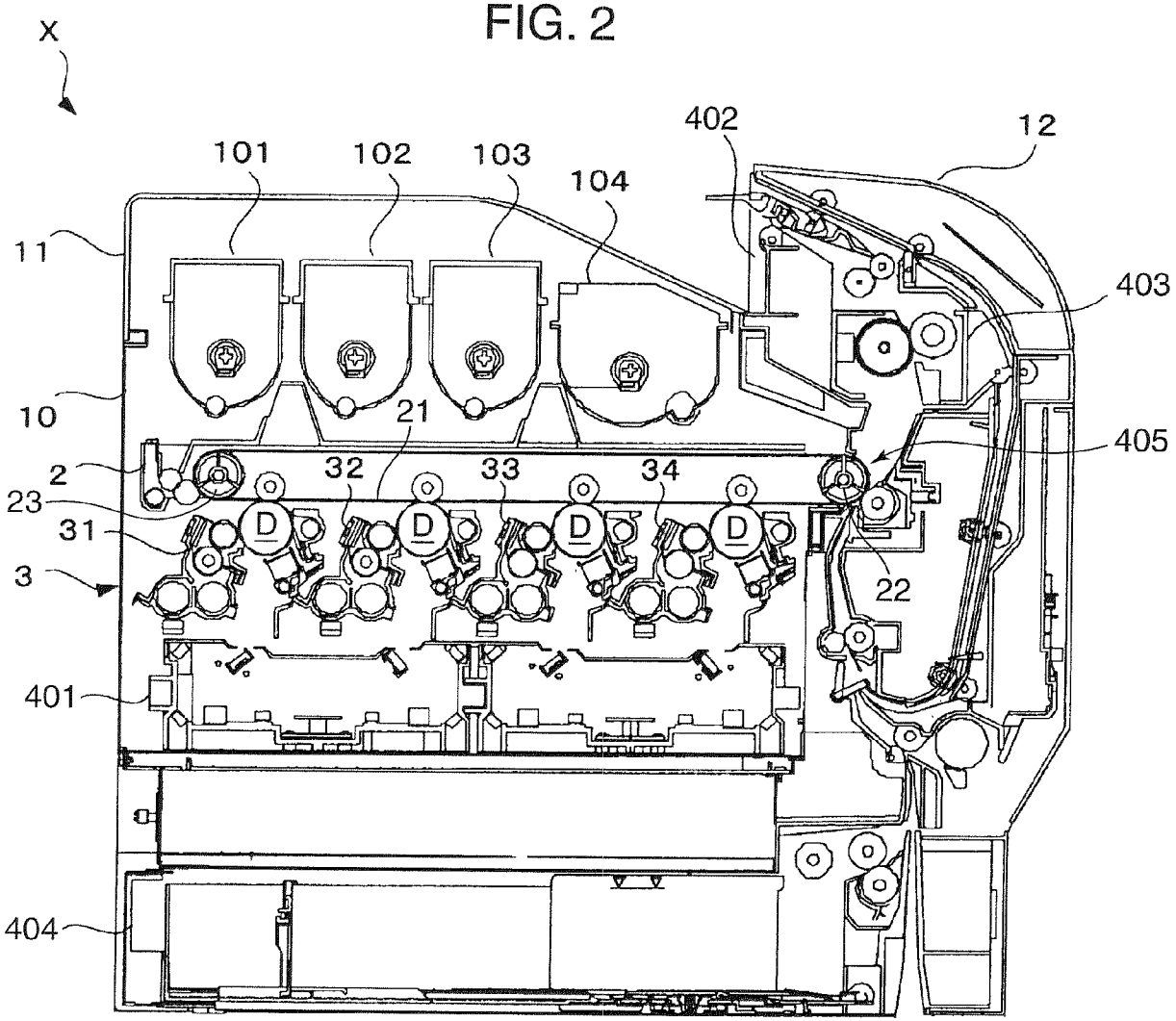
FIG. 2 is a side sectional view of the color printer of FIG. 1.

FIG. 1 is an external perspective view illustrating a color printer X according to a first embodiment of the image forming apparatus of the present invention. FIG. 2 is a side sectional view of the color printer of FIG. 1. Initially, the schematic constitution of a color printer X is explained below with reference to FIGS. 1 and 2. The color printer X is merely an example of an image forming apparatus of the present invention, and thus the present invention is applicable to a copying machine, a facsimile machine, a multifunction machine, and the like.

The color printer X has a schematic composition comprising toner containers 101, 102, 103, and 104 (developer containers), an intermediate transfer unit 2, an image forming unit 3 comprising developing devices 31, 32, 33, and 34, a laser scanner unit 401, a paper discharge unit 402, a fixing unit 403, a paper feed cassette 404, a housing 10 of an apparatus main body, a top cover 11, and a front cover 12. The color printer X also includes other components of a typical color printer such as a control circuit for controlling an operation of the color printer X.

The housing 10 is an outer body of the color printer X. The housing 10 includes the arrangement therein of toner containers 101, 102, 103, and 104, an intermediate transfer unit 2, an image forming unit 3, and a laser scanner unit 401 respectively in this order from top to bottom.

A top cover 11 functions as a cover member to cover a top surface of the housing 10 and also as a paper (sheet) output tray upon which papers are stacked after forming images thereon. A user or a service personnel opens the top cover 11 to attach or detach the toner containers 101, 102, 103, and 104, the intermediate transfer unit 2, the image forming unit 3, and the laser scanner unit 401, and performs maintenance from above. The front cover 12 covers a front side of the housing 10 and is opened and closed during attachment/detachment of the paper discharge unit 402 and the fixing unit 403 or during maintenance.

The toner containers 101, 102, 103, and 104 contain toner (developer) of the colors Y (yellow), M (magenta), C (cyan), and K (black), respectively, and supply the toner to the corresponding developing devices 31, 32, 33, and 34 of the image forming unit 3.

The image forming unit 3 is arranged beneath the toner containers 101, 102, 103, and 104, and has a plurality of image forming sections corresponding to each of the colors Y, M, C, and K. These image forming sections include, in addition to the developing devices 31, 32, 33, and 34, photosensitive drums D (image carriers), each of which bears a toner image of a different color. Also, each of the image forming sections includes such apparatus as a charging device for uniformly charging a peripheral surface of the photosensitive drum D and a cleaning device for cleaning the peripheral surface of the photosensitive drum D after finishing transfer of a toner image.

Each of the developing devices 31, 32, 33, and 34 develops (makes visible) an electrostatic latent image formed on the corresponding photosensitive drum D by using toner of the colors supplied by the toner containers 101, 102, 103, and 104. Monochrome or color toner images formed on the photosensitive drums D are primarily transferred onto an intermediate transfer belt 21 provided on the intermediate transfer unit 2.

The laser scanner unit 401 includes a light source and various optical instruments such as polygon mirrors, reflecting mirrors, and deflecting mirrors thereby forming an electrostatic latent image by irradiating light based on image data onto a peripheral surface of the photosensitive drum D of the respective image forming sections.

Figure 6:
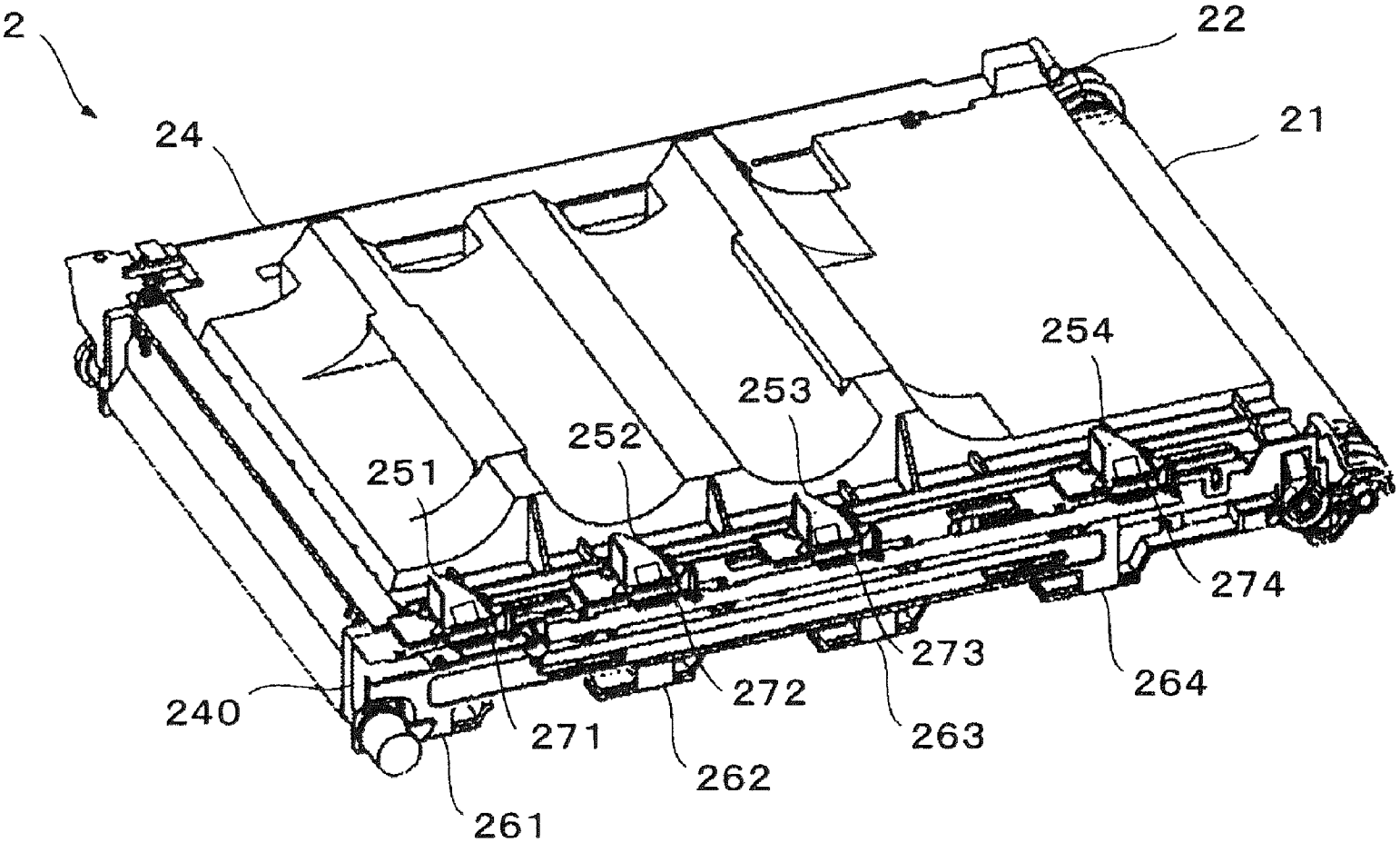
FIG. 6 is a perspective view of the intermediate transfer unit according to the first embodiment with toner inlet ports closed.
Figure 7:
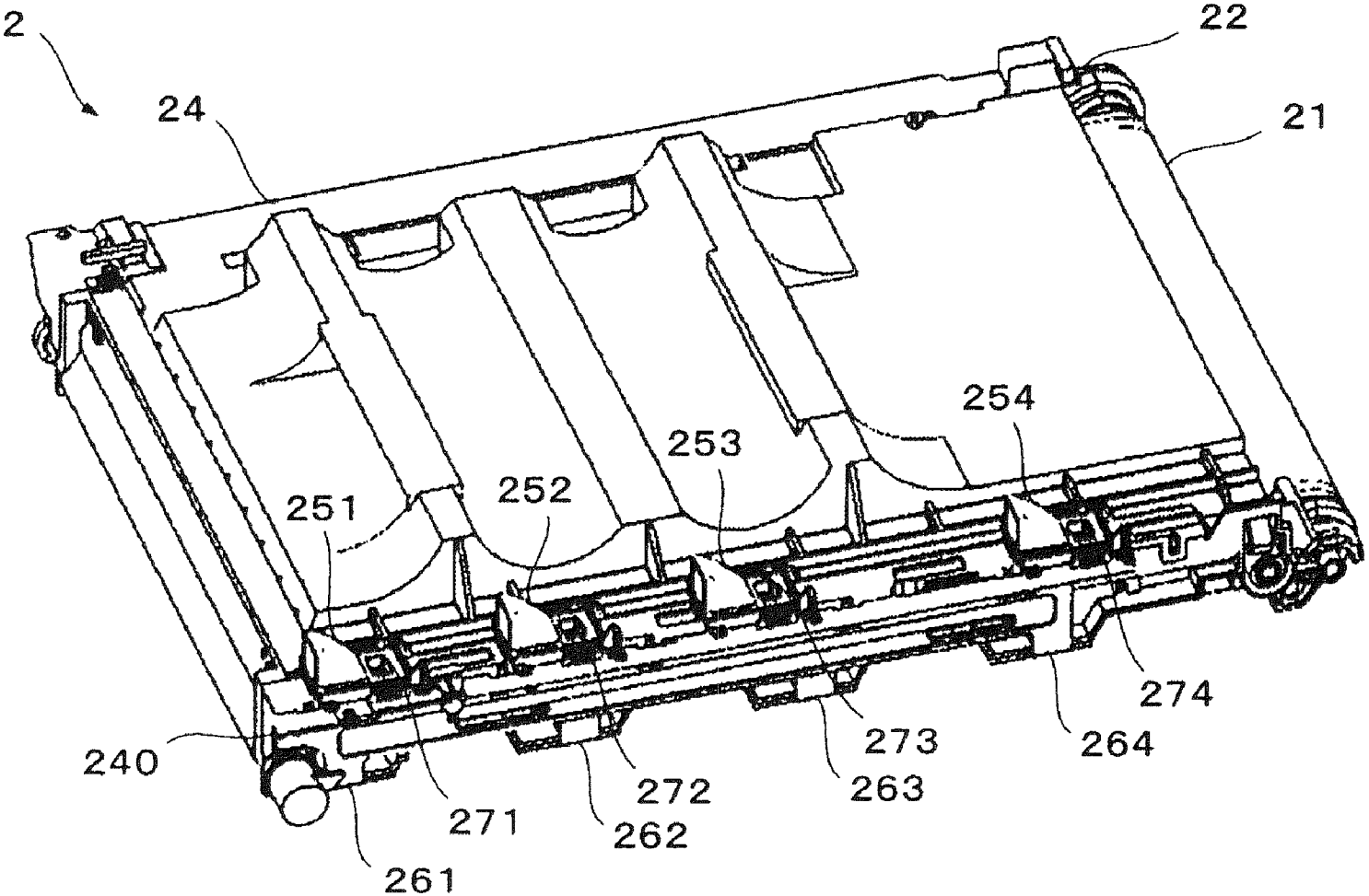
FIG. 7 is a perspective view of the intermediate transfer unit according to the first embodiment with the toner inlet ports open.

The intermediate transfer unit 2 includes an intermediate transfer belt 21 (intermediate transfer unit), drive rollers 22 and 23 (intermediate transfer unit driving mechanism), and a housing 24 (see FIGS. 6 and 7). Toner images are primarily transferred in a superimposed manner onto the intermediate transfer belt 21 from the photosensitive drums D, and the obtained toner image is secondarily transferred onto a paper supplied from a paper feed cassette 7 at a secondary transfer unit 405. The drive rollers 22 and 23 drive the intermediate transfer belt 21 such that it moves in an orbiting manner. The housing 24 supports the drive rollers 22 and 23 such that they are freely rotatable.

The paper feed cassette 404 contains papers on which images are to be formed, and is mounted onto the housing 10 on the side of the front cover 12 in a detachable manner.

The fixing unit 403 guides a paper to the paper discharge unit 402 after a toner image secondarily transferred from the intermediate transfer unit 2 has been fixed onto the paper. The fixing unit 403 includes a heat roller, a pressuring roller, and the like.

The paper discharge unit 402 discharges a paper conveyed from the fixing unit 403 onto a top cover 11 serving as a paper output tray. The paper discharge unit 402 includes a paper discharge roller for conveying papers.

Figure 3:
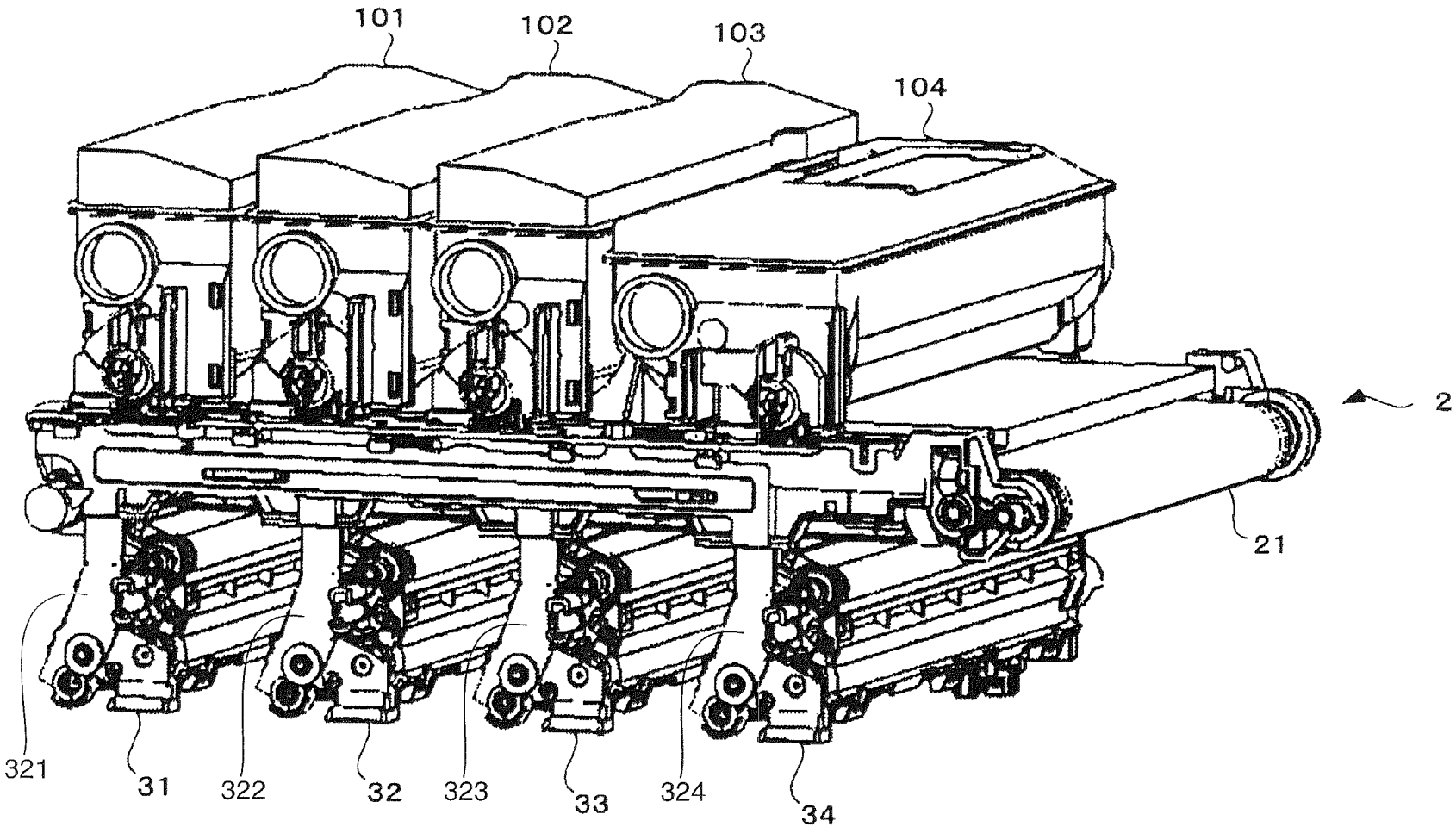
FIG. 3 is a perspective view illustrating toner containers and developing devices connected to the intermediate transfer unit according to the first embodiment of the present invention.
Figure 4:
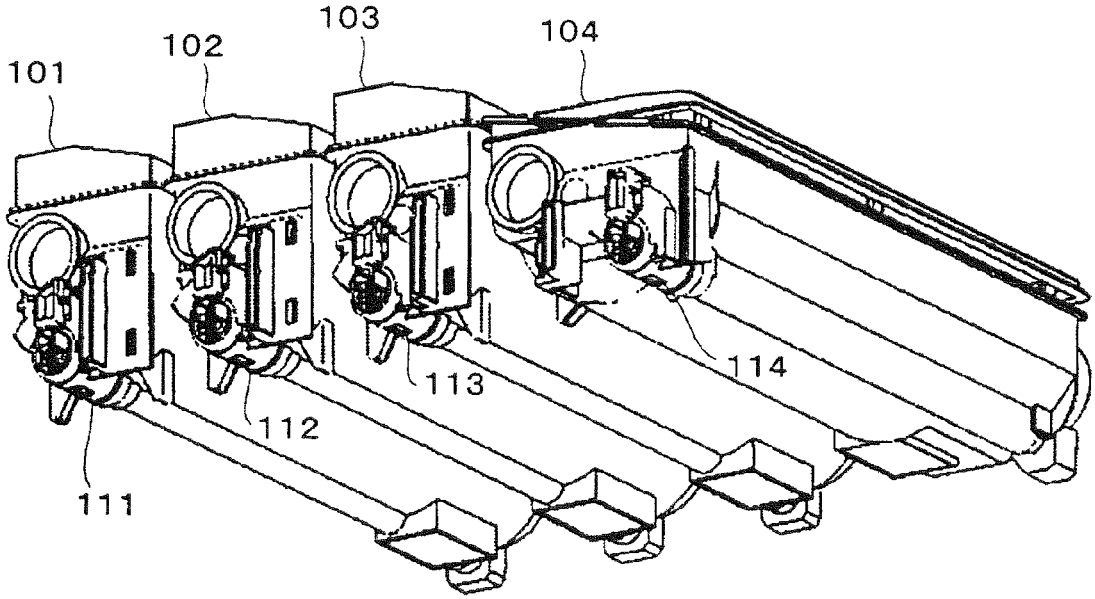
FIG. 4 is a perspective view illustrating toner containers.

FIG. 3 is a perspective view illustrating the toner containers 101, 102, 103, and 104, the intermediate transfer unit 2, and the developing devices 31, 32, 33, and 34 shown extracted from FIG. 2 and connected one another. FIG. 4 is a perspective view of the toner containers 101, 102, 103, and 104; and FIG. 5 is a relevant component drawing of the developing device 31 (32, 33, and 34).

As shown in FIG. 3, the intermediate transfer unit 2 is arranged between the four laterally adjacent toner containers 101, 102, 103, and 104 and the four developing devices 31, 32, 33, and 34 which are provided laterally adjacent and parallel to each other beneath the toner containers 101, 102, 103, and 104. The toner containers 101, 102, 103, and 104, the intermediate transfer unit 2, and the developing devices 31, 32, 33, and 34 are fixedly positioned to one another or onto the housing 10 by means of not-shown fixing members. Detailed explanation of the intermediate transfer unit 2 is given below.

As shown in FIG. 4, the toner containers 101, 102, 103, and 104 are provided with toner supply ports 111, 112, 113, and 114 (examples of toner supply ports), respectively, in order to supply toner contained in each container. The toner supply ports 111, 112, 113, and 114 are opened and closed by a not-shown container shutter.

Figure 5:
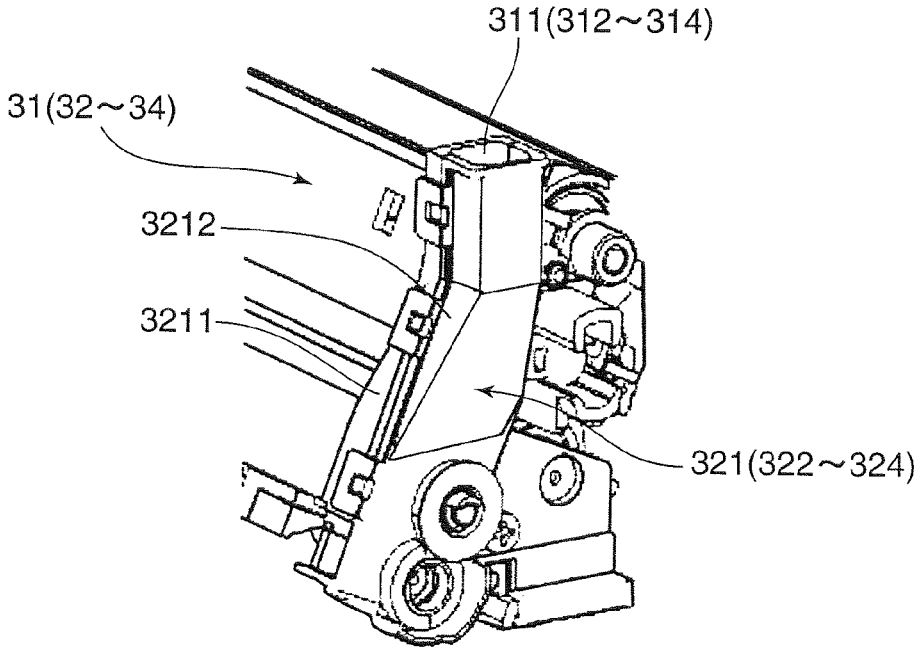
FIG. 5 is a perspective view illustrating one end of a developing device in its longitudinal direction.

As shown in FIG. 5, the developing device 31 (32, 33, and 34) includes a toner receiving port 311 (312, 313, and 314; examples of developer receiving ports) at one end in the longitudinal direction of the developing device 31, and a toner guide unit 321 (322, 323, and 324) for guiding toner supplied from the toner receiving port 311 (312, 313, and 314) into the developing device from a bottom thereof. The toner guide unit 321 serves as a toner containing chamber (developer containing chamber) for temporarily containing toner, and includes a first wall member 3211 and a second wall member 3212, the details of which is described below with reference to FIGS. 8, 9, and 10.

Figure 40:
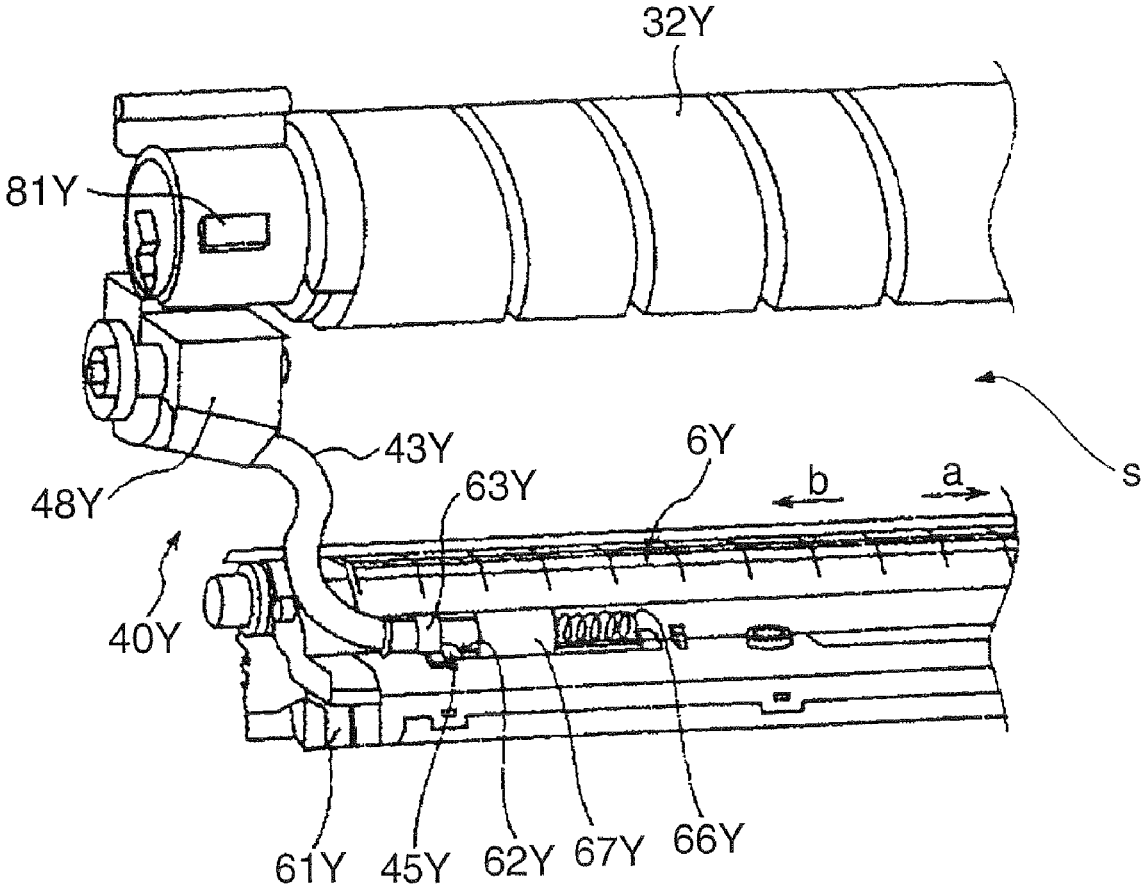
PRIOR ART FIG. 40
FIG. 40 is a perspective view illustrating conventional art.

As described above, the conventional apparatus was so structured that the toner supply ports 111, 112, 113, and 114 are connected to the toner receiving ports 311, 312, 313, and 314 through pipes (pipe 43Y in FIG. 40) which detour around the outside of the intermediate transfer unit 2. Therefore, the image forming apparatus becomes larger in its width direction by at least the dimensions of the pipes. Also, since each of the toner supply ports 111, 112, 113, and 114 need to be connected to the corresponding toner receiving ports 311, 312, 313, and 314 through independent pipes, there were problems of poor assembly work efficiency, low productivity, and inconvenient maintenance.

On the other hand, the color printer X according to the present embodiment has a feature that the color printer X is provided with paths for supplying toner to each of the developing devices 31, 32, 33, and 34 from the corresponding toner containers 101, 102, 103, and 104 that are formed in the intermediate transfer unit 2. The feature is described below.

FIG. 6 is a perspective view illustrating the intermediate transfer unit 2 according to the first embodiment with toner inlet ports 271, 272, 273, and 274 closed; and FIG. 7 is a perspective view illustrating the intermediate transfer unit 2 according to the first embodiment with toner inlet ports 271, 272, 273, and 274 open.

The intermediate transfer unit 2 schematically includes the intermediate transfer belt 21 for secondarily transferring the toner images that are primarily transferred from the photosensitive drums D provided in an image forming unit 3 to the paper, the rotating drive rollers 22 and 23 upon which the intermediate transfer belt 21 runs and is driven thereon, and a housing 24 for supporting the drive rollers 22 and 23.

The intermediate transfer belt 21 is an endless belt stretched with a predetermined tensile force between the two drive rollers 22 and 23. Either one of the two drive rollers 22 and 23 is rotationally driven by a driving force of a not-shown motor or the like provided in the color printer X. By the rotational motion thereof, the intermediate transfer belt 21 is orbitally driven and the other one of the drive rollers 22 and 23 rotates.

The housing 24 has a rectangular shape when viewed from above and includes walls that cover both sides of the intermediate transfer belt 21 and support the drive rollers 22 and 23 with freedom of rotation respectively, and a top plate on which the toner containers 101, 102, 103, and 104 are arranged. At one end of the housing 24 (one side edge of the intermediate transfer belt 21) there are provided toner inlet ports 271, 272, 273, and 274 (developer inlet ports) positionally corresponding to the respective toner supply ports 111, 112, 113, and 114 provided in the toner containers 101, 102, 103, and 104, toner outlet ports 261, 262, 263, and 264 (developer outlet ports) positionally corresponding to the respective toner receiving ports 311, 312, 313, and 314 provided in the developing devices 31, 32, 33, and 34, and toner supply paths 240 (developer supply paths) for supplying toner to each of the toner outlet ports 261, 262, 263, and 264 from the corresponding toner inlet ports 271, 272, 273, and 274.

The toner inlet ports 271, 272, 273, and 274 are opened and closed by the shutter members 251, 252, 253, and 254 provided slidably on the top plate of the housing 24. The shutter members 251, 252, 253, and 254 close the toner inlet ports 271, 272, 273, and 274 in FIG. 6, while the shutter members 251, 252, 253, and 254 slide to open the toner inlet ports 271, 272, 273, and 274 in FIG. 7. When the toner containers 101, 102, 103, and 104 are mounted on a top of the intermediate transfer unit 2, the shutter members 251, 252, 253, and 254 slide to open the toner inlet ports 271, 272, 273, and 274 upon contacting the toner containers 101, 102, 103, and 104.

Edges of the toner inlet ports 271, 272, 273, and 274 are provided with not-shown sealing members which contact the edges of the toner supply ports 111, 112, 113, and 114 of the toner containers 101, 102, 103, and 104 in order to prevent toner from leaking. On the other hand, edges of the toner outlet ports 261, 262, 263, and 264 are also provided with not-shown sealing members which contact the edges of the toner receiving ports 311, 312, 313, and 314 of the developing devices 31, 32, 33, and 34 in order to prevent toner from leaking.

The toner guide units 321, 322, 323, and 324 following the toner receiving ports 311, 312, 313, and 314 are described in detail with reference to FIGS. 5, 8, 9, and 10. As described with reference to FIG. 5, the developing device 31 (32, 33, and 34) includes a toner guide unit 321 (322, 323, and 324) as a toner containing chamber at one end of the developing device 31 in its longitudinal direction. The toner receiving port 311 (312, 313, and 314) is provided on a top end of the toner guide unit 321 to serve as a toner receiving unit for receiving toner having dropped by means of gravity from the toner outlet port 261 (262, 263, 364).

Figure 8:
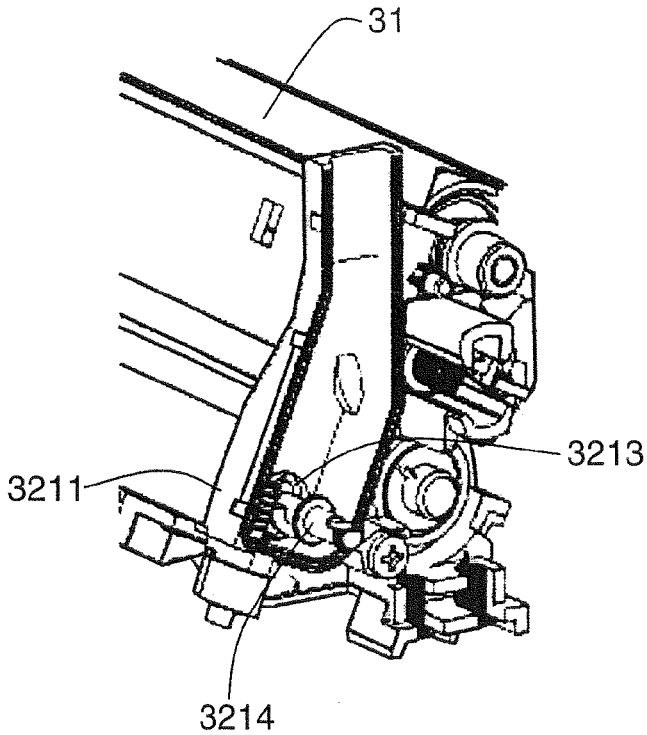
FIG. 8 is a perspective view of the developing device of FIG. 5 illustrating the same with a second wall member removed therefrom.

The toner guide unit 321 includes a first wall member 3211 positioned at one end of the developing device 31 in its longitudinal direction (see FIG. 8), a second wall member 3212 which is removable from the first wall member 3211 and which forms an enclosed space with the first wall member 3211 (see FIG. 9), and a developing device side toner supply section 3213 for supplying toner to the developing device 31 (see FIG. 8).

Figure 9:
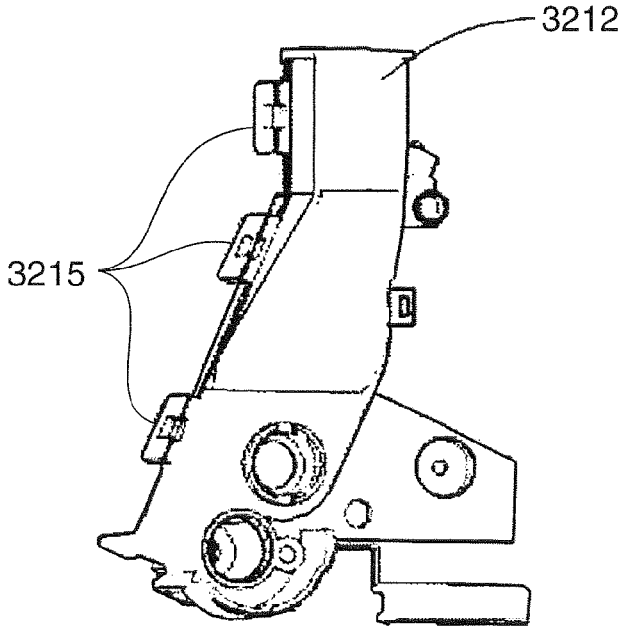
FIG. 9 is a perspective view illustrating the second wall member alone.

FIG. 8 is a perspective view illustrating the developing device 31 of FIG. 5 with the second wall member 3212 removed; and FIG. 9 is a perspective view illustrating the second wall member 3212 alone as removed from the developing device 31. The first wall member 3211 is formed as one piece with the developing device 31 and is vertically arranged so as to enclose a periphery of a side surface of the developing device 31. The second wall member 3212 has a plurality of engaging pieces 3215 for engaging the periphery of the first wall member 3211, and is removably coupled with the first wall member 3211 so as to close an opening portion of the first wall member 3211.

The toner guide unit 321 includes the first wall member 3211 and the second wall member 3212 as described above and may expose a complicated shape on the side surface of the developing device 31, i.e., mounting holes for receiving a developing roller, bearings for a plurality of mixing members, and a spiral 3214 for conveying toner within the developing device 31. As such, a die for molding the housing of the developing device 31 can be made as a simple open type, resulting in reduced manufacturing costs owing to this simplified manufacturing process. The first wall member 3211 may be formed independently from a side wall member of the developing device 31.

The toner supplied to the toner guide unit 321 temporarily resides inside the toner guide unit 321, and then is supplied into the developing device 31 from the toner guide unit 321 by the spiral 3214 of the developing device 31 that extends into the toner guide unit 321.

Figure 10:
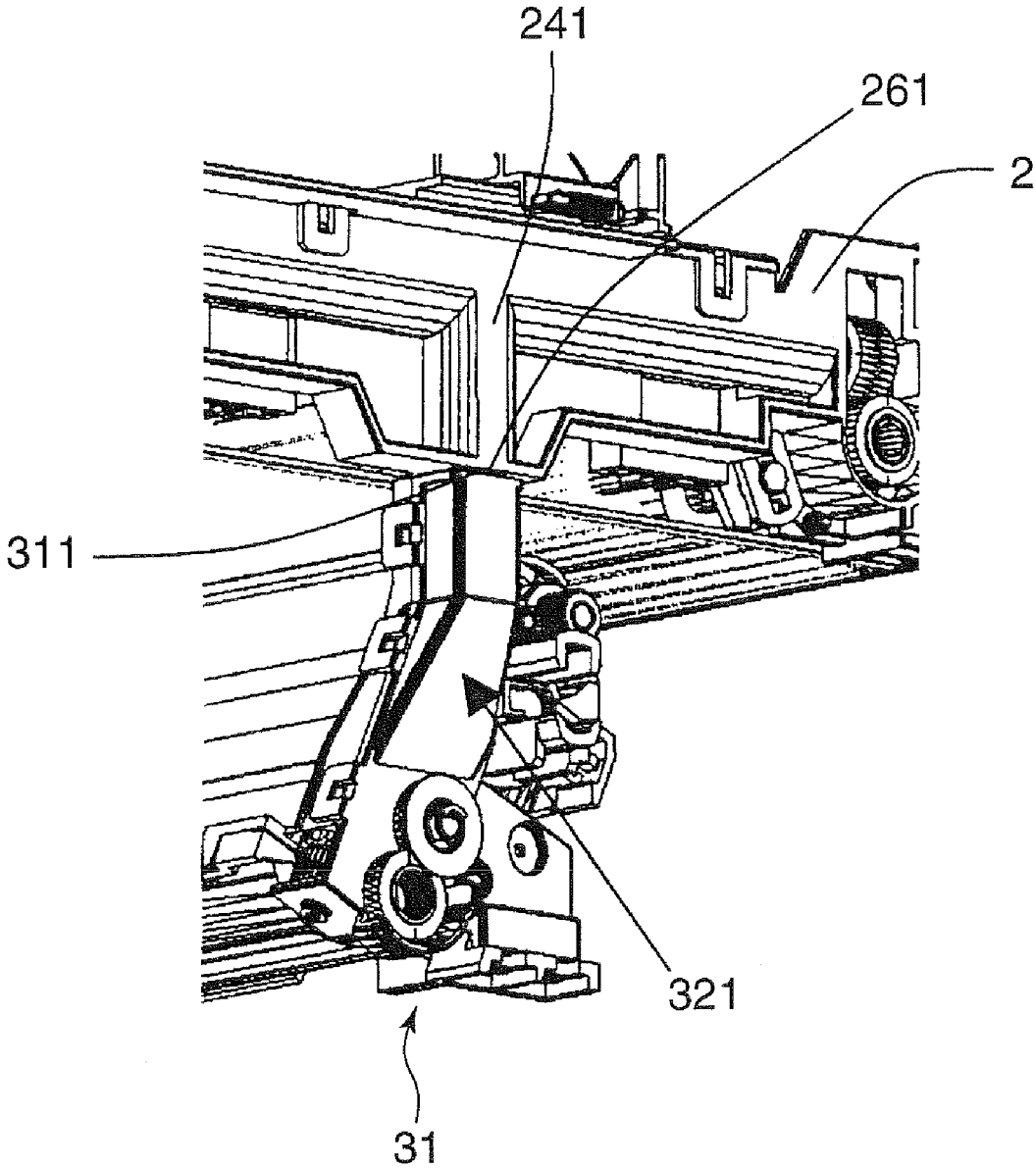
FIG. 10 is a perspective view illustrating the intermediate transfer unit and the developing device connected to each other.

FIG. 10 is a perspective view illustrating the intermediate transfer unit 2 connected to the developing device 31 by the toner guide unit 321. The toner receiving port 311 is positioned immediately below the toner outlet port 261. The toner guide unit 321 is formed so as to extend downward from the toner receiving port 311, such that toner is supplied to a position beneath the toner guide unit 321, i.e., a position of the developing device side toner supply section 3213, by means of gravity.

Figure 11:
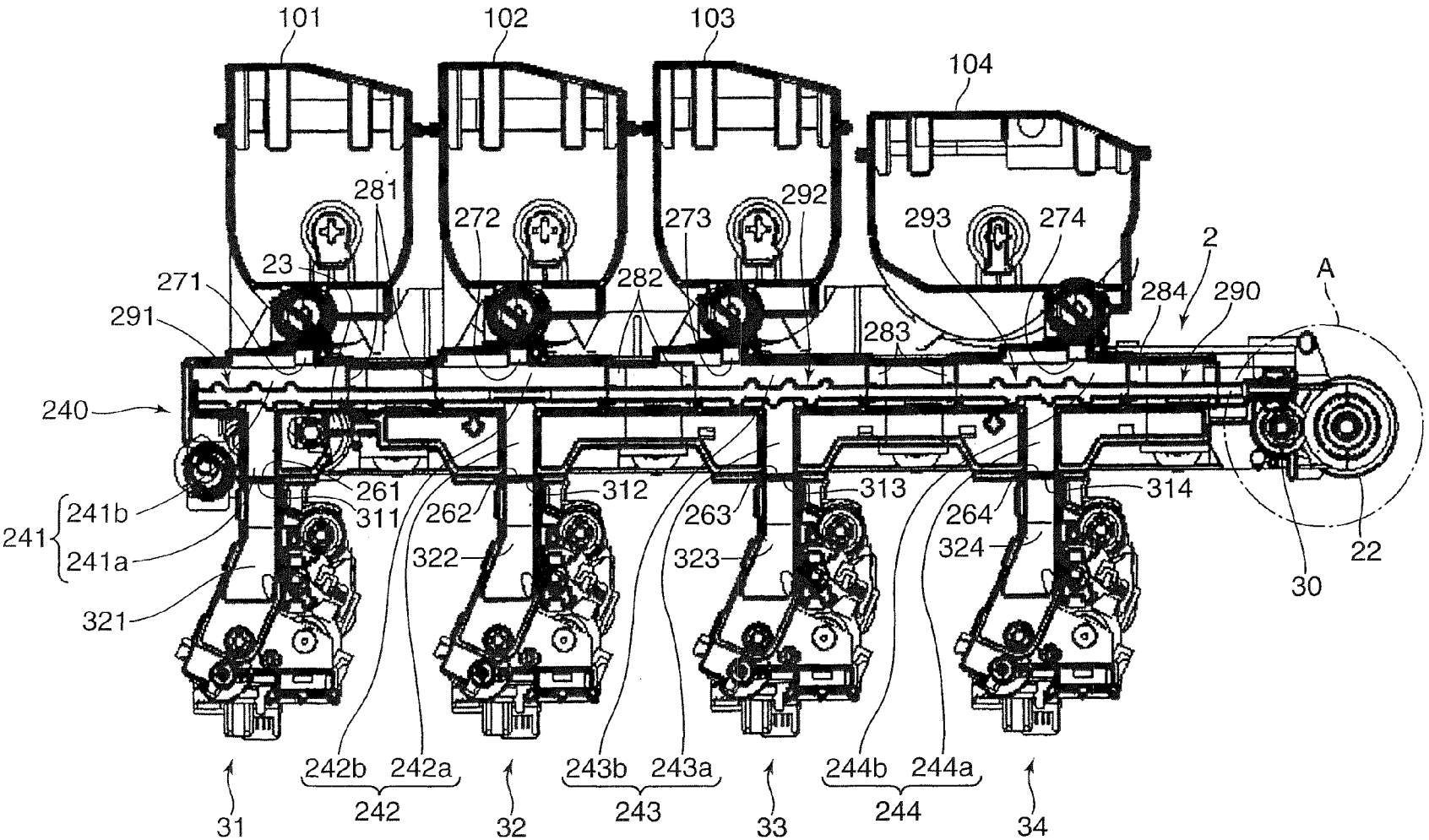
FIG. 11 is a cross sectional view illustrating the toner containers and the developing devices connected to the intermediate transfer unit according to the first embodiment.
Figure 12:
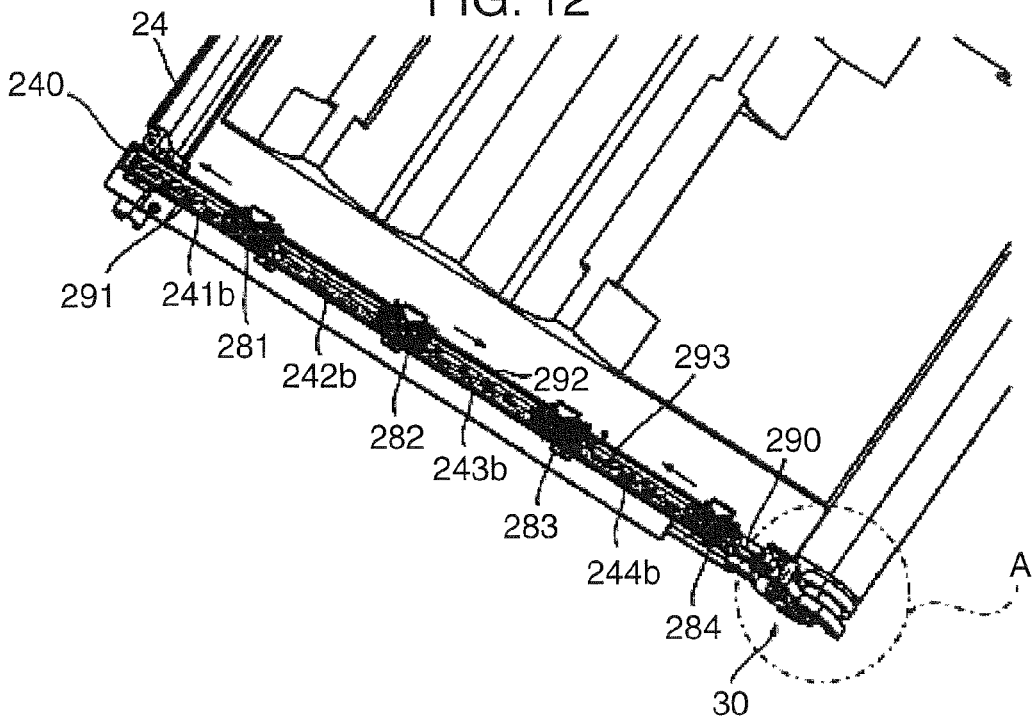
FIG. 12 is a top plan view of the intermediate transfer unit showing toner supply paths.
Figure 13:
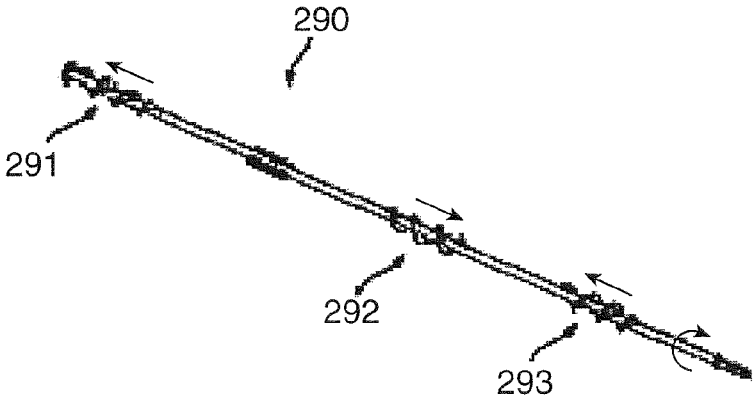
FIG. 13 is a perspective view of a toner conveying member.
Figure 14:
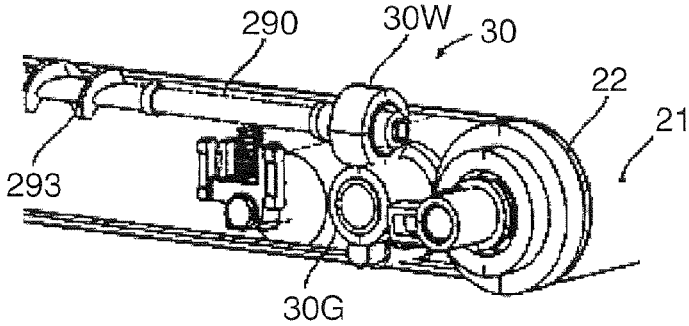
FIG. 14 is a partially enlarged view of an area A encircled by an alternating long and short dashed line in FIGS. 11 and 12.

An internal structure of the toner supply path 240 is described below with reference to FIGS. 11, 12, 13, and 14. FIG. 11 is a cross-section view illustrating the toner containers 101, 102, 103, and 104 installed on an upper section of the intermediate transfer unit 2 and the developing devices 31, 32, 33, and 34 installed on a lower section of the intermediate transfer unit 2. FIG. 12 is an internal structural view of the toner supply path 240. FIG. 13 is a part drawing of a toner conveying member 290 provided in the toner supply path 240. FIG. 14 is a partially enlarged view of an area A encircled by an alternating long and short dashed line in FIGS. 11 and 12.

As shown in FIG. 11, the toner supply path 240 according to the present embodiment includes four independent toner supply paths 241, 242, 243, and 244, each connecting the toner inlet ports 271, 272, 273, and 274 to the corresponding toner outlet ports 261, 262, 263, and 264.

The toner supply paths 241, 242, 243, and 244 include vertical paths 241*a*, 242*a*, 243*a*, and 244*a* formed substantially in a vertical direction and horizontal paths 241*b*, 242*b*, 243*b*, and 244*b* formed substantially in a horizontal direction, respectively. The vertical paths 241*a*, 242*a*, 243*a*, and 244*a* are connected to substantially center positions of the horizontal paths 241*b*, 242*b*, 243*b*, and 244*b* in the horizontal direction, respectively. Each of the toner supply paths 241, 242, 243, and 244 thus includes a substantially "T"-shaped toner distribution space when viewed from the side.

The four horizontal paths 241*b*, 242*b*, 243*b*, and 244*b* are arranged such that they are positioned on a single axis line. According to the present embodiment, the horizontal paths 241*b*, 242*b*, 243*b*, and 244*b* are so formed that a single horizontal space is partitioned by the below described four sealing members 281, 282, 283, 284. The toner inlet ports 271, 272, 273, and 274 are defined in appropriate positions on the top surfaces of the horizontal paths 241*b*, 242*b*, 243*b*, and 244*b*.

As shown in FIG. 11, the toner outlet port 262 corresponding to the toner container 102 for magenta is positioned substantially vertically beneath the corresponding toner inlet port 272. Therefore, the magenta toner supplied through the toner inlet port 272 directly drops into the vertical path 242*a* of the toner supply path 242 by means of gravity to finally reach the toner outlet port 262.

The color printer X is so designed that the arrangement of the toner supply ports 111, 112, 113, and 114 of the toner containers 101, 102, 103, and 104 are not in alignment with the arrangement of the toner receiving ports 311, 312, 313, and 314 of the developing devices 31, 32, 33, and 34, for the purpose of reducing the size of the color printer X and providing a larger capacity of the toner container 104 containing black toner. As such, with regard to the toner supply paths 241, 243, and 244 (excluding the magenta toner supply path 242), the toner outlet ports 261, 263, and 264 are not positioned vertically beneath the toner inlet ports 271, 273, and 274, respectively.

To flexibly accommodate such an arrangement as described above, the horizontal paths 241*b*, 243*b*, and 244*b* are provided. That is, a yellow toner, a cyan toner, and a black toner supplied from the toner inlet ports 271, 273, and 274 respectively can flow into the vertical paths 241*a*, 243*a*, and 244*a* through the corresponding horizontal paths 241*b*, 243*b*, and 244*b*. The horizontal path 242*b* may be omitted here since the magenta toner supply path 242 has no misalignment.

Gravity is insufficient to convey the toner through the horizontal paths 241*b*, 242*b*, 243*b*, and 244*b*. Consequently, it is desirable that the toner supply paths 241, 243, and 244 include a means for allowing smooth conveyance of the toner from the horizontal path 241*b*, 243*b*, and 244*b* to the corresponding vertical paths 241*a*, 243*a*, and 244*a*.

In view of the above, the present embodiment includes a toner conveying member 290 within the toner supply path 240 in order to convey the toner in a horizontal direction. As shown in FIG. 13, the toner conveying member 290 is a bar-shaped member in which three independent sections, namely a first, a second, and a third screw sections 291, 292, and 293 respectively are formed into one piece with a rotation shaft. The toner conveying member 290 is arranged to passes through the four horizontal paths 241*b*, 242*b*, 243*b*, and 244*b*, as shown in FIGS. 11 and 12. One end of the toner conveying member 290 (the side of the drive roller 22) is provided with a rotational drive unit 30 for rotationally driving the toner conveying member 290. The first, the second, and the third screw sections 291, 292, and 293 positionally correspond to the insides of the horizontal paths 241*b*, 243*b*, and 244*b*, respectively.

When the toner conveying member 290 is rotationally driven by the rotation drive unit 30, the toner is conveyed in the horizontal direction within the horizontal paths 241*b*, 243*b*, and 244*b*. The toner is then further conveyed to the positions of the vertical paths 241*a*, 243*a*, and 244*a* to allow the toner to drop therefrom by means of gravity. Here, the toner conveying member 290 and the rotation drive unit 30 are examples of developer conveying mechanisms. The horizontal path 242*b* also may include a similar screw section therein.

Since the toner conveying member 290 is arranged such that it passes through the toner supply paths 241, 242, 243, and 244 for different color toner, each of the toner supply paths 241, 242, 243, and 244 are provided with sealing members 281, 282, 283, 284 made of an elastic material for blocking distribution of the toner to the outside. Therefore, the toner can be prevented from distributing between the toner supply paths 241, 242, 243, and 244, and between the toner supply path 244 and the rotation drive unit 30.

In the present text, a composition having one toner conveying member 290 comprising the first, the second, and the third screw sections 291, 292, and 293 is given as an example that reduces the number of parts. However, the first, the second, and the third screw sections 291, 292, and 293 may be provided as independent members.

As shown in FIG. 11, vertical misalignments between the toner inlet ports 271, 273, and 274 and the toner outlet ports 261, 263, and 264 are made in a right-to-left or left-to-right direction such that the yellow toner supply path 241 and the black toner supply path 244 have different misalignment directions than that of the cyan toner supply path 243. Hence, the toner particles should be conveyed by the horizontal paths 241*b* and 244*b* of the toner supply path 241 and 244 in a different direction as that of the horizontal path 243*b* of the toner supply path 243.

In view of the above, as shown in FIG. 13, the toner conveying member 290 according to the present embodiment is so formed that the helical direction of the first screw section 291 and the third screw section 293 is opposite to that of the second screw section 292. Namely, it is provided that the toner conveying direction of the first and the third screw sections 291 and 293 is opposite to the toner conveying direction of the second screw section 292 when the toner conveying member 290 is rotatably driven.

Accordingly, when the toner conveying member 290 comprising the first, the second, and the third screw sections 291, 292, and 293 formed thereon is rotatably driven in the direction of the arrow shown in FIG. 13, the toner is conveyed in an arrow direction shown in FIG. 12 within the horizontal paths 241*b*, 243*b*, and 244*b* by the respective motions of the first, the second, and the third screw sections 291, 292, and 293. More specifically, the toner supplied from the toner inlet ports 271, 273, and 274 to the horizontal paths 241*b*, 243*b*, and 244*b* is conveyed to the vertical paths 241*a*, 243*a*, and 244*a* leading to the toner outlet ports 261, 263, and 264.

Even in the case where the toner conveying directions are different to one another for the horizontal paths 241*b*, 243*b*, and 244*b*, a single toner conveying member 290 can be used by differentiating the helical directions (conveying directions) of the screw sections 291, 292, and 293 formed on the toner conveying member 290.

FIG. 14 is a perspective view illustrating a rotation drive unit 30 for rotationally driving the toner conveying member 290. The rotation drive unit 30 includes a worm wheel 30W coupled to one end of the toner conveying member 290 and a worm gear 30G meshed with the worm wheel 30W and the drive roller 22.

In the intermediate transfer unit 2 according to the present embodiment, a rotational drive force of the drive roller 22 is conveyed to the toner conveying member 290 through the worm gear 30G and the worm wheel 30W. In other words, the toner conveying member 290 is rotated in accordance with the rotation of the drive roller 22.

As stated above, a driving source of the drive roller 22 is also used as a driving source of the toner conveying member 290, which helps avoid an increase in cost. Further, it is suitable for noise control since the number of driving sources can be prevented from increasing. Any drive force obtainable from other driving sources within the color printer X may be used as long as driving occurs when toner supply is required from the toner container 101, 102, 103, and 104 to the developing devices 31, 32, 33, and 34.

As described above, the color printer X comprising the intermediate transfer unit 2 according to the first embodiment provides the developing devices 31, 32, 33, and 34, wherein the intermediate transfer unit 2 and the toner containers 101, 102, 103, and 104 are provided above which in this order and mounted onto the housing 10 such that the toner supply ports 111, 112, 113, and 114 can be connected to the corresponding toner receiving ports 311, 312, 313, and 314 through the corresponding toner supply paths 241, 242, 243, and 244 of the intermediate transfer unit 2. Consequently, better efficiency of assembly and enhanced productivity and maintenance are possible as compared to the conventional case where the toner supply ports 111, 112, 113, and 114 are connected to the corresponding toner receiving ports 311, 312, 313, and 314 through independent pipes, respectively.

Figure 15:
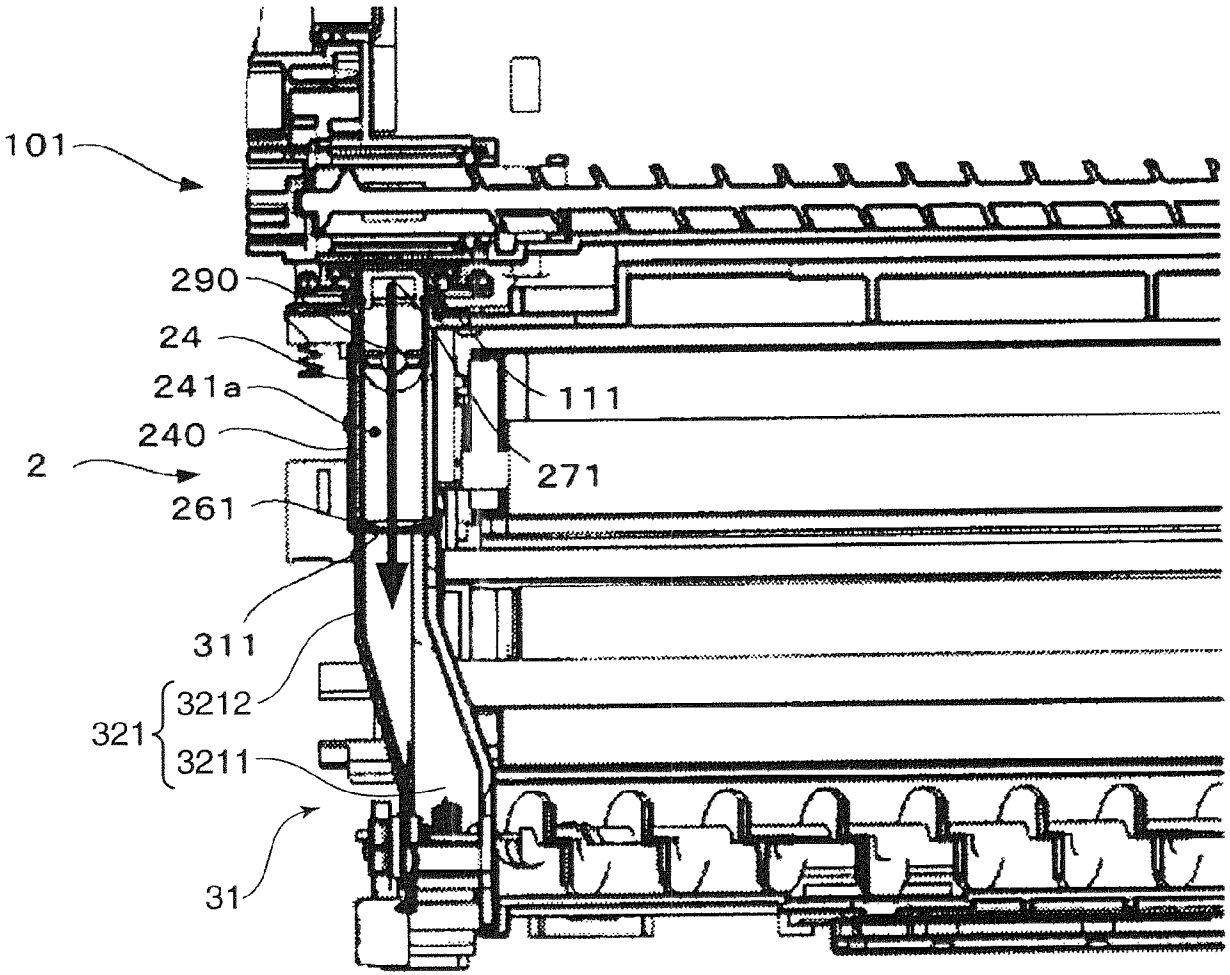
FIG. 15 is across sectional view of a color printer illustrating from the front thereof the toner containers and the developing devices connected to the intermediate transfer unit.

FIG. 15 is a cross sectional view of relevant components viewing from the side of the front cover 12 (from the front of the color printer X) illustrating the developing device 31, the intermediate transfer unit 2, and the toner container 101 connected to one another.

As shown in FIG. 15, the toner supplied from the toner supply port 111 of the toner container 101 passes through the toner supply path 240 formed on the housing 24 of the intermediate transfer unit 2 and are supplied in a substantially vertical downward direction into the toner receiving port 311 of the developing device 31. Therefore, it is not necessary for the pipe to be arranged detouring around the outside of the housing 24 of the intermediate transfer unit 2 as it has been conventionally done, such that the dimension of the color printer X in its width direction can be made smaller to achieve down-sizing of the color printer X.

Second Embodiment

A second embodiment includes a modification of the toner conveying member 290 according to the above described first embodiment, but the other structures are identical to that of the first embodiment.

The toner conveying member 290 as described in the first embodiment provides the first, the second, and the third screw sections 291, 292, and 293 that convey the toner only in the horizontal direction within the toner supply paths 241, 243, and 244. For example, in FIG. 11, the first screw section 291 conveys the toner only in a left direction, while the second screw section 292 conveys the toner particles only in a right direction.

Figure 16:
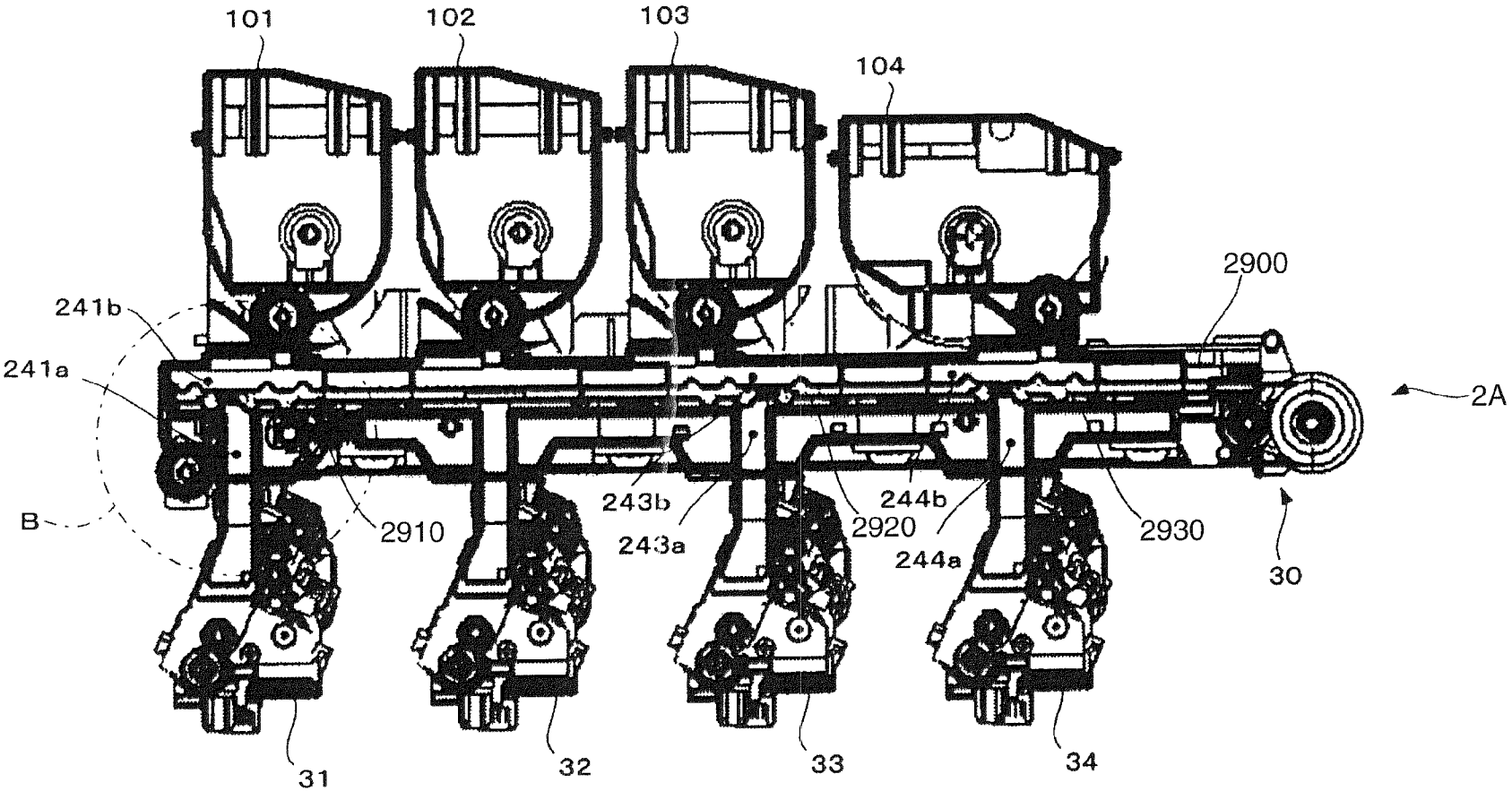
FIG. 16 is a cross sectional view illustrating the toner containers and the developing devices connected to the intermediate transfer unit according to a second embodiment.
Figure 17:
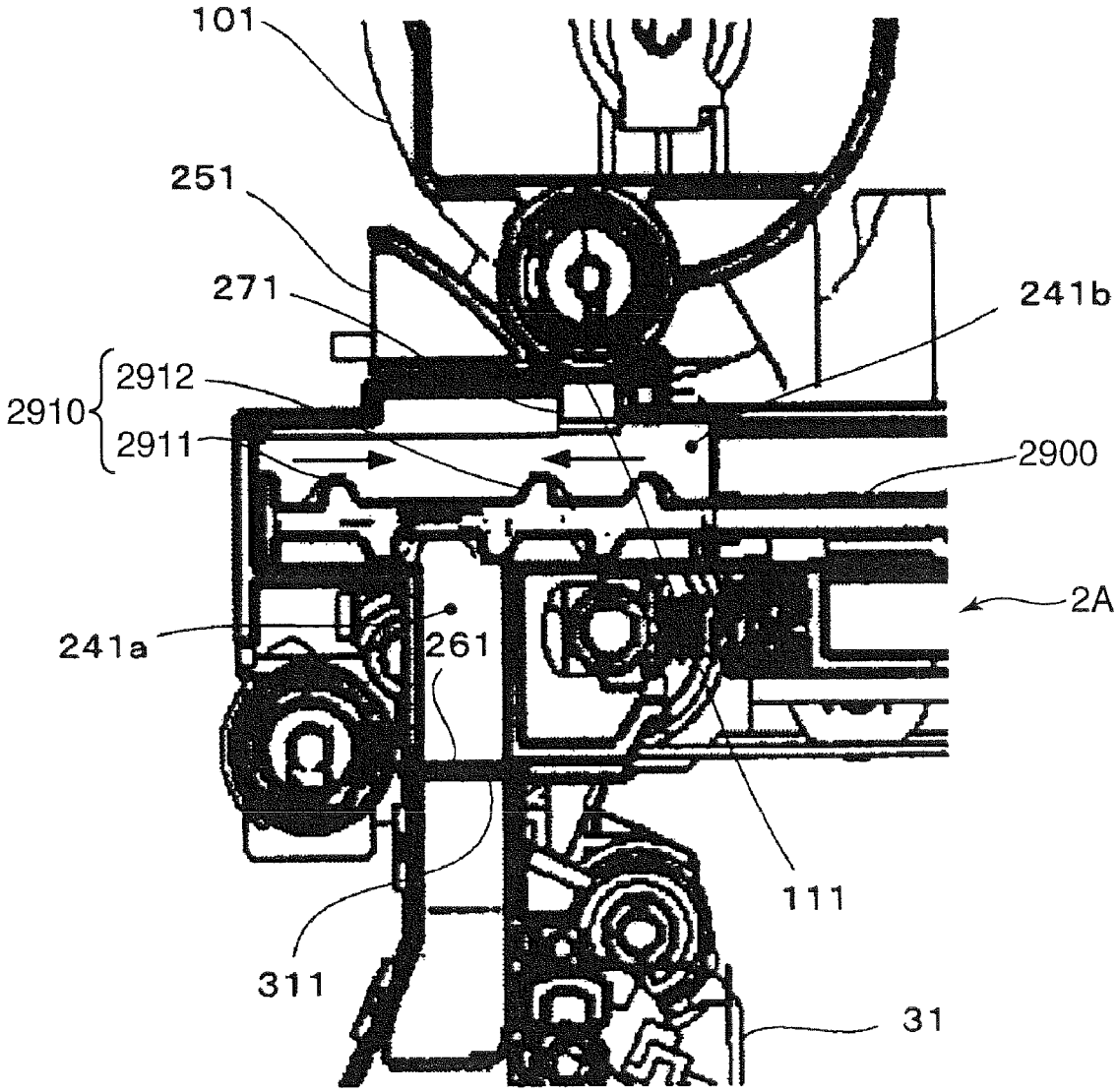
FIG. 17 is a partially enlarged view of an area B encircled by an alternating long and short dashed line in FIG. 16.

FIG. 16 is a cross sectional view of the intermediate transfer unit 2A according to the second embodiment in which a toner conveying member 2900 which is a modification of the toner conveying member 290 is described. FIG. 17 is a partially enlarged view of an area B encircled by an alternating long and short dashed line in FIG. 16. Like reference numbers are attached and descriptions are omitted for like components described in the first embodiment.

As shown in FIG. 16, each of the first, the second, and the third screw sections 2910, 2920, and 2930 formed in the toner conveying member 2900 is provided with a two-way screw section having different helical directions (conveying directions) in order to convey the toner particles to the vertical paths 241*a*, 243*a*, and 244*a* such that the toner is collected from both ends of the horizontal paths 241*b*, 243*b*, and 244*b* of the toner supply paths 241, 243, and 244.

For example, as shown in FIG. 17, the first screw section 2910 positionally corresponding to the horizontal path 241*b* of the toner supply path 241 includes a left screw section 2911 having a structure wherein the toner is conveyed from a left end of the horizontal path 241*b* toward the vertical path 241*a*, and a right screw section 2912 having a structure wherein the toner is conveyed from a right end of the horizontal path 241*b* toward the vertical path 241*a*. Accordingly, the toner can be circulated within the horizontal path 241*b*, which contributes to prevent the toner from clumping. The second and the third screw sections 2920 and 2930 arranged in the toner supply paths 243 and 244 have structures identical to those described above.

Third Embodiment

A third embodiment has such a structure that the developing devices can be precisely positioned with regard to the intermediate transfer unit, and has a basic structure identical to the above described first embodiment.

In the above exemplified color printer X, it is desirable that each apparatus unit is readily detachable for the purpose of assembly and maintenance thereof. However, a mounting position of the developing device 3 with regard to the intermediate transfer unit 2 should be accurate and the positional accuracy and convenience of an attachment/detachment operation should be satisfied at the same time.

Figure 18:
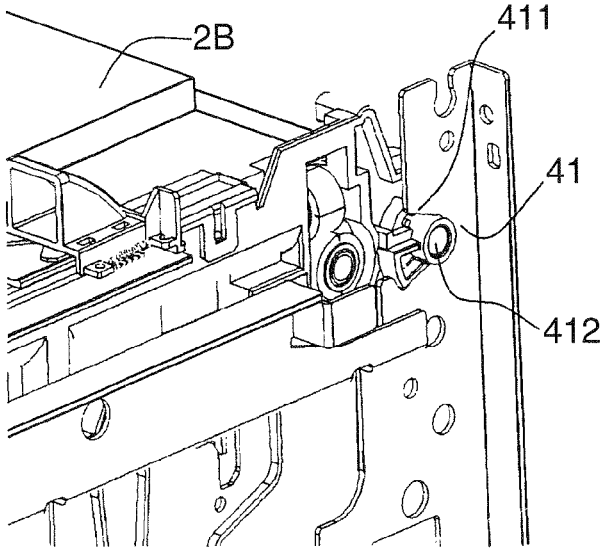
FIGS. 18 and 19 are perspective views each illustrating an intermediate transfer unit according to a third embodiment mounted onto a frame of an apparatus main body.
Figure 19:
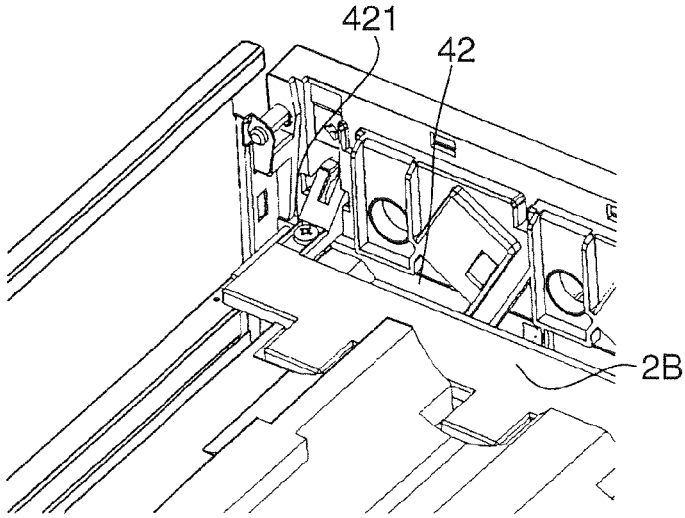

FIGS. 18 and 19 are perspective views illustrating the intermediate transfer unit 2B according to the third embodiment mounted on a frame of the apparatus main body of the color printer X. FIGS. 18 and 19 exemplify a first main body frame 41 positioned at a side surface of a side where the toner supply path 240 of the intermediate transfer unit 2B is provided and a second main body frame 42 positioned at a side surface of an opposite side of the former side surface. The first and the second frames 41, 42 are illustrated in their entirety in FIG. 37 which is cited later.

As shown in FIG. 18, the first main body frame 41 is provided with a substantially U-shaped groove 411 open to a lateral direction. On the other hand, the intermediate transfer unit 2B is provided with a bush 412 mounted rotatably at a predetermined position. The groove 411 receives the bush 412 to non-retractably fix its position. Accordingly, the intermediate transfer unit 2B is accurately and fixedly positioned on the first main body frame 41.

As shown in FIG. 19, the intermediate transfer unit 2B is secured also on the second main body frame 42 through a similar bush and a similar groove (not shown), the second main body frame 42 being positioned opposite to the first main body frame 41 having the intermediate transfer unit 2B arranged therebetween. The intermediate transfer unit 2B is also secured to the first main body frame 41 and the second main body frame 42 through screws 421 at two corners, respectively, in addition to a secured section by the bush 412. That is, the intermediate transfer unit 2B is accurately positioned on the first main body frame 41 and the second main body frame 42 at four corners thereof. The intermediate transfer unit 2B is readily removable by unscrewing the screw 421 to allow the bush 412 to rotate in order to release the bush from its retaining position.

Figure 20:
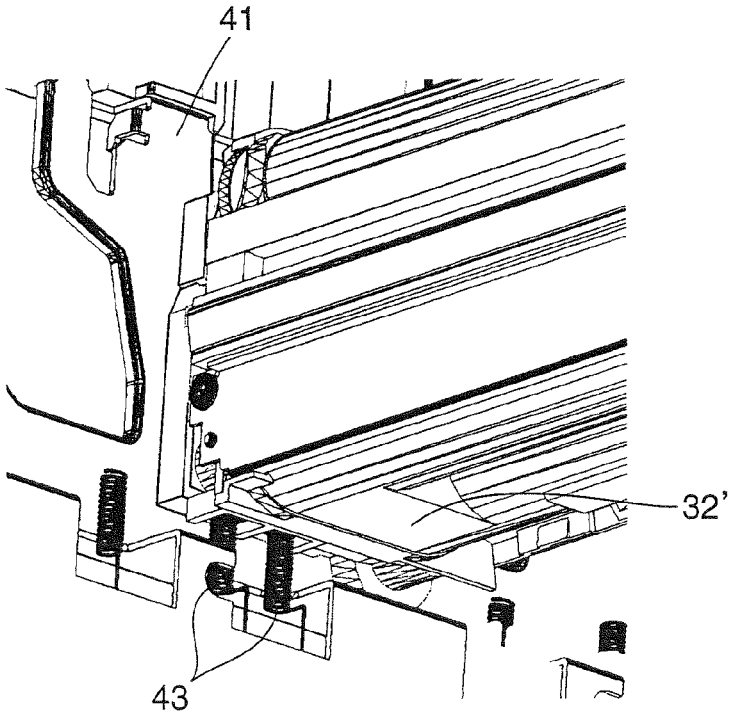
FIG. 20 is a perspective view illustrating the developing device pressed down by an elastic body.

As shown in FIG. 20, the developing device 32, (31, 33, and 34) is pressed upwardly (a direction of the intermediate transfer unit 2B) by means of a plurality of springs 43 (one example of an elastic body) disposed on a bottom surface of the developing device. FIG. 20 only illustrates a bottom surface 32' and a left side surface of the housing of the magenta developing device 32.

The springs 43 are spring parts involving electrical connection with a known sleeve roller and a magnetic roller (not shown) of the developing device 32. The springs 43 apply to the bottom surface 32' of the developing device 32 a biasing force for biasing the developing device 32 upwardly. Accordingly, the developing device 32 contacts the intermediate transfer unit 2B with a pressing force. The same are applied to the other developing devices 31, 33, and 34.

Figure 21:
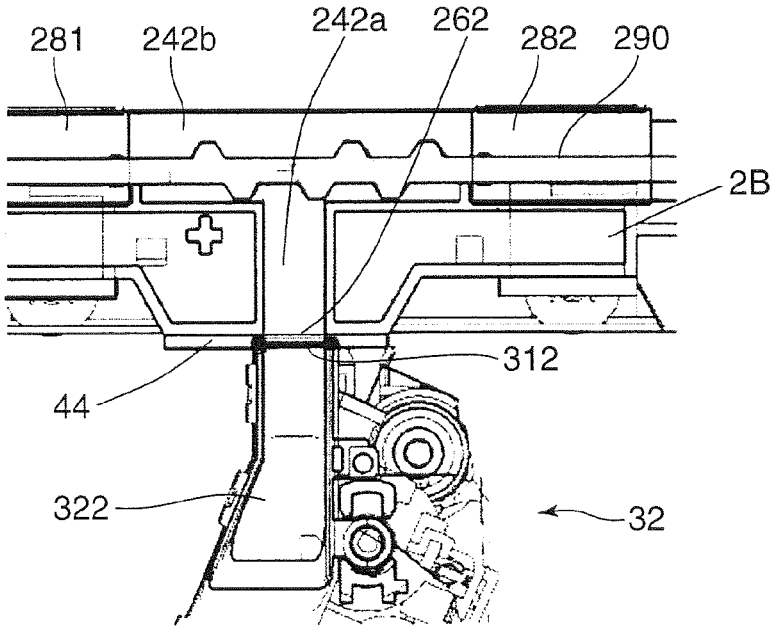
FIG. 21 is a cross sectional view illustrating an interface between the developing device and the intermediate transfer unit.

FIG. 21 is a cross sectional view illustrating contact between the intermediate transfer unit 2B and the developing device 32. With the above stated pressing force, the toner receiving port 312 of the developing device 32 contacts the toner outlet port 262 of the intermediate transfer unit 2B in a pressing state to be fixedly positioned. A sponge seal 44 is arranged between the toner outlet port 262 and the toner receiving port 312 in order to prevent the toner particles from leaking through an interface therebetween.

According to the third embodiment, since no dedicated members such as a guide rail or a guide arm are necessary for positioning the developing devices 31, 32, 33, and 34, manufacturing costs are decreased. Also, accurate positioning of the developing devices 31, 32, 32, and 34 can be realized. Further, four developing devices 31, 32, 33, and 34 can be released from their secured condition at one time by detaching the intermediate transfer unit 2B, resulting in a large improvement of the ease of maintenance.

Fourth Embodiment

A fourth embodiment has such a structure that the vertical paths 241*a*, 242*a*, 243*a*, and 244*a* of the toner supply path 240 as described in the above embodiment are provided with coil springs.

In the vertical paths 241*a*, 242*a*, 243*a*, and 244*a* in which toner drops by means of gravity, the vertical paths may be clogged up by the toner since the toner adheres to an interior wall surface of the vertical paths. Therefore, it is desirable to provide a mechanism in which the toner adhered onto the interior wall surface of the vertical paths 241*a*, 242*a*, 243*a*, and 244*a* is scraped out from the surface.

Figure 22:
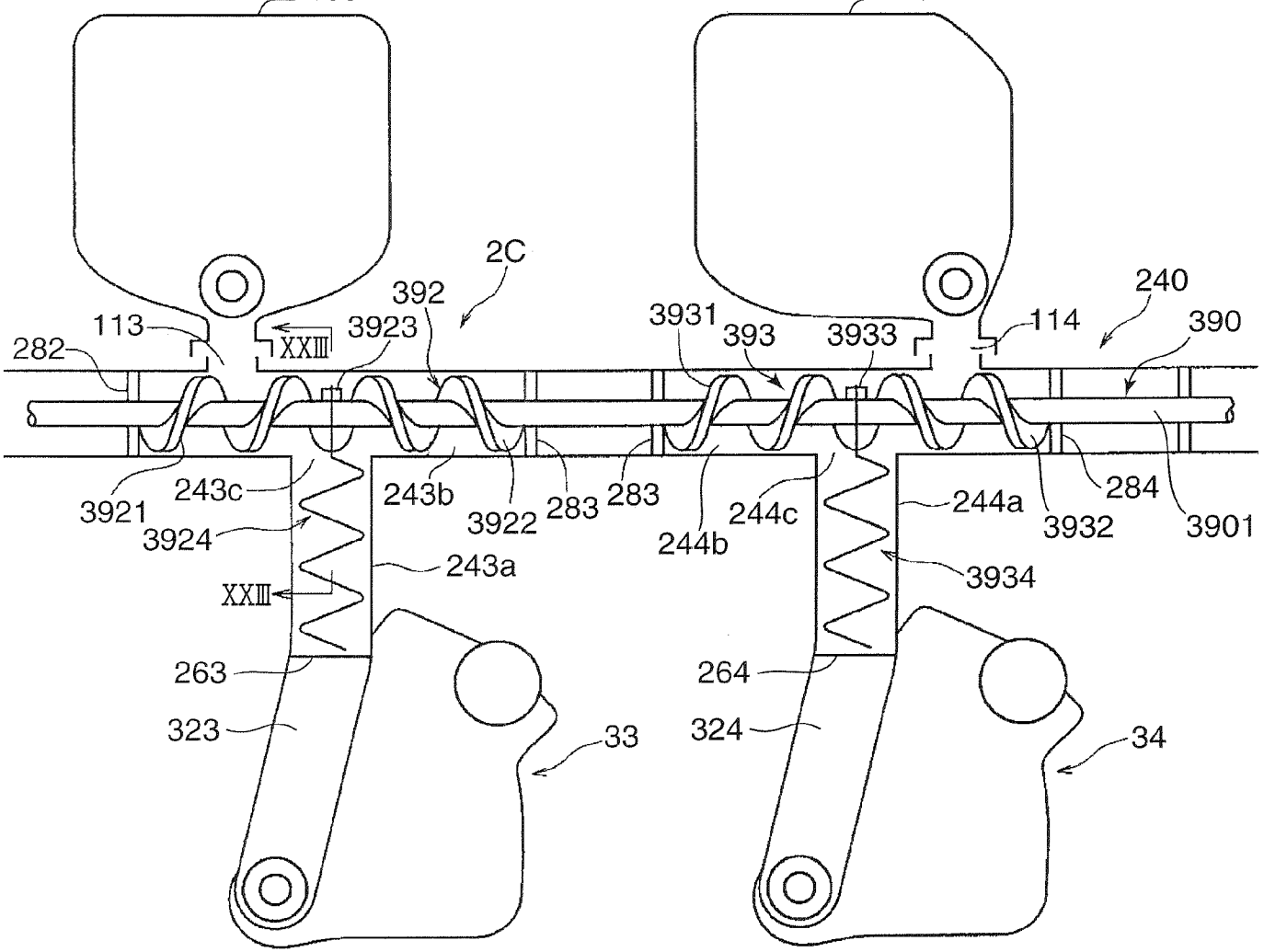
FIG. 22 is a schematic view illustrating a toner conveying member of an intermediate transfer unit according to a fourth embodiment.
Figure 23:
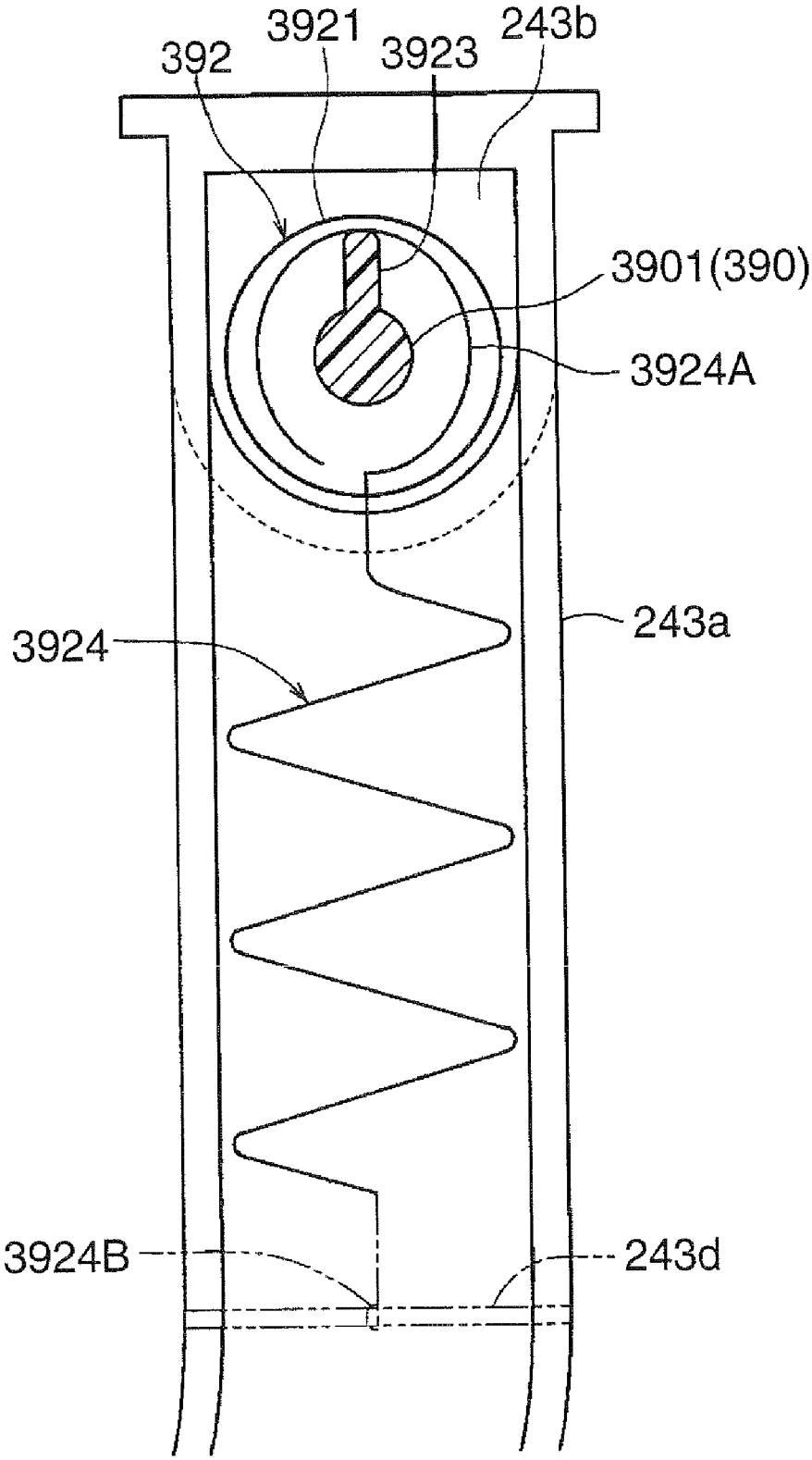
FIG. 23 is a cross sectional view taken along line XXIII-XXIII in FIG. 22.

FIG. 22 is a schematic view illustrating a toner conveying member 390 of an intermediate transfer unit 2C according to the fourth embodiment. FIG. 23 is a cross sectional view of FIG. 22 taken along line XXIII-XXIII. Here, the toner supply paths from the cyan toner container 103 and the black toner container 104 are extracted to be drawn schematically. Components having identical reference numbers as those in FIGS. 11 and 16 are identical components.

The toner conveying member 390 is applied to the toner supply path 240 of the intermediate transfer unit 2C. This toner conveying member 390 has a structure identical to the toner conveying member 2900 as described in the second embodiment, and includes a rotational shaft 3901, and a second screw section 392 and a third screw section 393 (a first screw section is omitted here) provided on this rotational shaft 3901.

The second screw section 392 is provided with a left screw section 3921 and a right screw section 3922 having opposite helical directions (conveyance directions) to each other in order to convey the toner from both ends of the horizontal path 243B such that the toner collects at the vertical path 243*a*. The third screw section 393 is also provided with a left screw section 3931 and a right screw section 3932 in order to convey the toner from both ends of the horizontal path 244*b* such that the toner collects at the vertical path 244*a*.

The rotational shaft 3901 has a crossing area extending to cross over the toner outlet ports 263 and 264. Coil springs 3924 and 3925 are hung from the crossing area of the rotational shaft 3901 so as to be rotatable relative to the rotational shaft. More specifically, the crossing area is an area of the rotational shaft 3901 positioned above the crossover sites 243C and 244C of the horizontal paths 243*b* and 244*b* and the vertical paths 243*a* and 244*a*.

The crossing area of the rotational shaft 3901 is provided with a projection 3923. The projection 3923, having a predetermined thickness in a peripheral direction and a predetermined width in the rotational-shaft axis direction, projects outward in a radial direction from a certain area of the outer peripheral surface of the rotational shaft 3901. A top of the projection is formed into an elliptical surface or a curved surface as viewed from the axis direction. A length in a radial direction between a shaft center of the rotational shaft 3901 and a top of the projection 3923 is set to be slightly smaller than a radius of the left screw section 3921 and the right screw section 3922. Other embodiments of this projection 3923 include a cam shaped projection in which an outer peripheral surface of the circular shape of the rotational shaft 3901 is used as a base circle.

The coil spring 3924 is provided within the vertical path 243*a* and extends in a vertical direction. A top end retaining part 3924A of the coil spring 3924 is retained onto the rotational shaft 3901 at its crossing area in a relatively rotatable manner such that the top end retaining part encloses the outer periphery comprising the projection 3923 in the radial direction. Accordingly, the coil spring 3924 is suspended from the rotational shaft 3901. The bottom end 3924B of the coil spring 3924 is left unretained with regard to the vertical path 243*a*.

The top end retaining part 3924A is bent into a curved shape, namely, into a so-called hook shape, an elliptical shape, or an almost annular shape when it is viewed in an axis direction of the rotational shaft 3901, when suspended from the rotational shaft 3901. Here, the top end retaining part 3924A is formed into an oval and almost annular shape. The coil spring 3924 has a circular shape in its cross section and is positioned so as to have a predetermined space between the outer peripheral surface of the coil spring and an interior wall surface of the vertical path 243*a*. The coil spring 3934 also has a similar structure as the one described above, and is also arranged within the vertical path 244*a*.

When the toner conveying member 390 is rotationally driven, the suspended coil spring 3924 moves up and down between a maximum stroke created between the outer peripheral surface of the rotational shaft 3901 and a top surface of the projection 3921. Since the coil spring 3924 is not retained at its bottom end 3924B and thus is freely movable, the coil spring repeatedly expands and contracts, and oscillates within the vertical path 243*a* in various directions such as a vertical direction, a radial direction or a combination thereof. Therefore, the toner particles dropping within the vertical path 243*a* loosen, resulting in a smooth drop. The toner particles adhered to the interior wall surface of the vertical path 243*a* are also be scraped off.

As shown in FIG. 23 with an alternating long and two short dashed line, the bottom end 3924B of the coil spring 3924 may be retained by a retainer pin 243*d* arranged in the vertical path 243*a*. In this case, when the toner conveying member 390 is rotationally driven, the coil spring repeatedly expands and contracts, and oscillates within the vertical path 243*a* in various directions such as a vertical direction, a radial direction and a combination thereof, although motion of the toner conveying member is substantially limited since the coil spring 3924 is retained at its bottom end 3924B.

According to the fourth embodiment, a possible deficiency that the vertical paths 243*a* and 244*a* are clogged up by the toner can be reliably prevented merely by the coil springs 3924, 3934 being suspended over the toner conveying member 390.

Fifth Embodiment

A fifth embodiment has such a structure that the toner inlet ports of the intermediate transfer unit can be opened and closed in association with an attachment/detachment operation of the toner containers.

Figure 24:
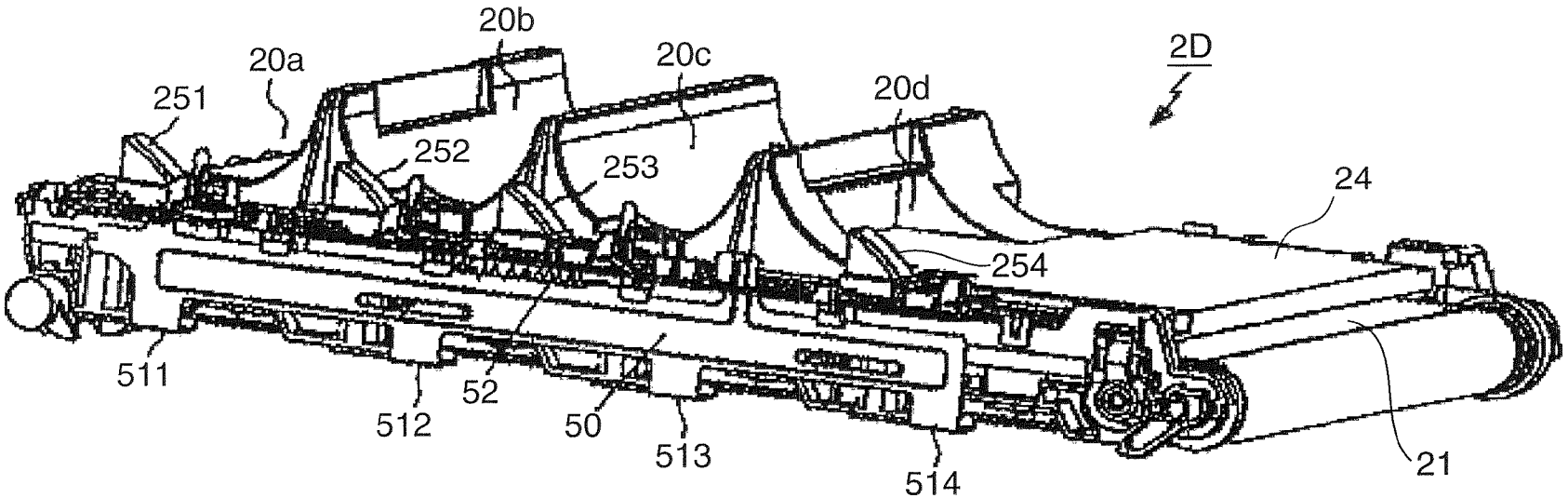
FIG. 24 is a perspective view of an intermediate transfer unit according to a fifth embodiment.
Figure 25:
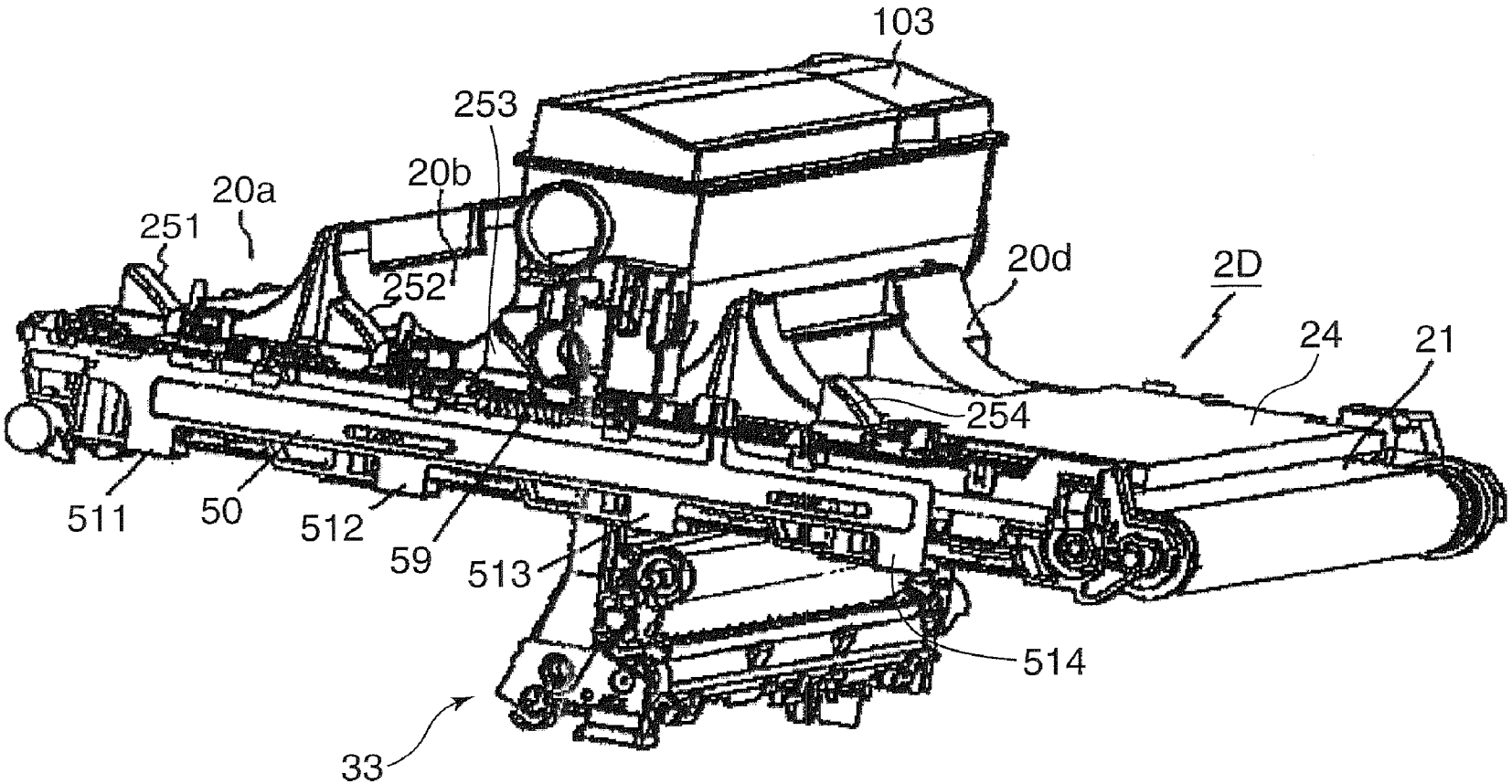
FIG. 25 is a perspective view illustrating one toner container and one developing device connected to the intermediate transfer unit according to the fifth embodiment.
Figure 26:
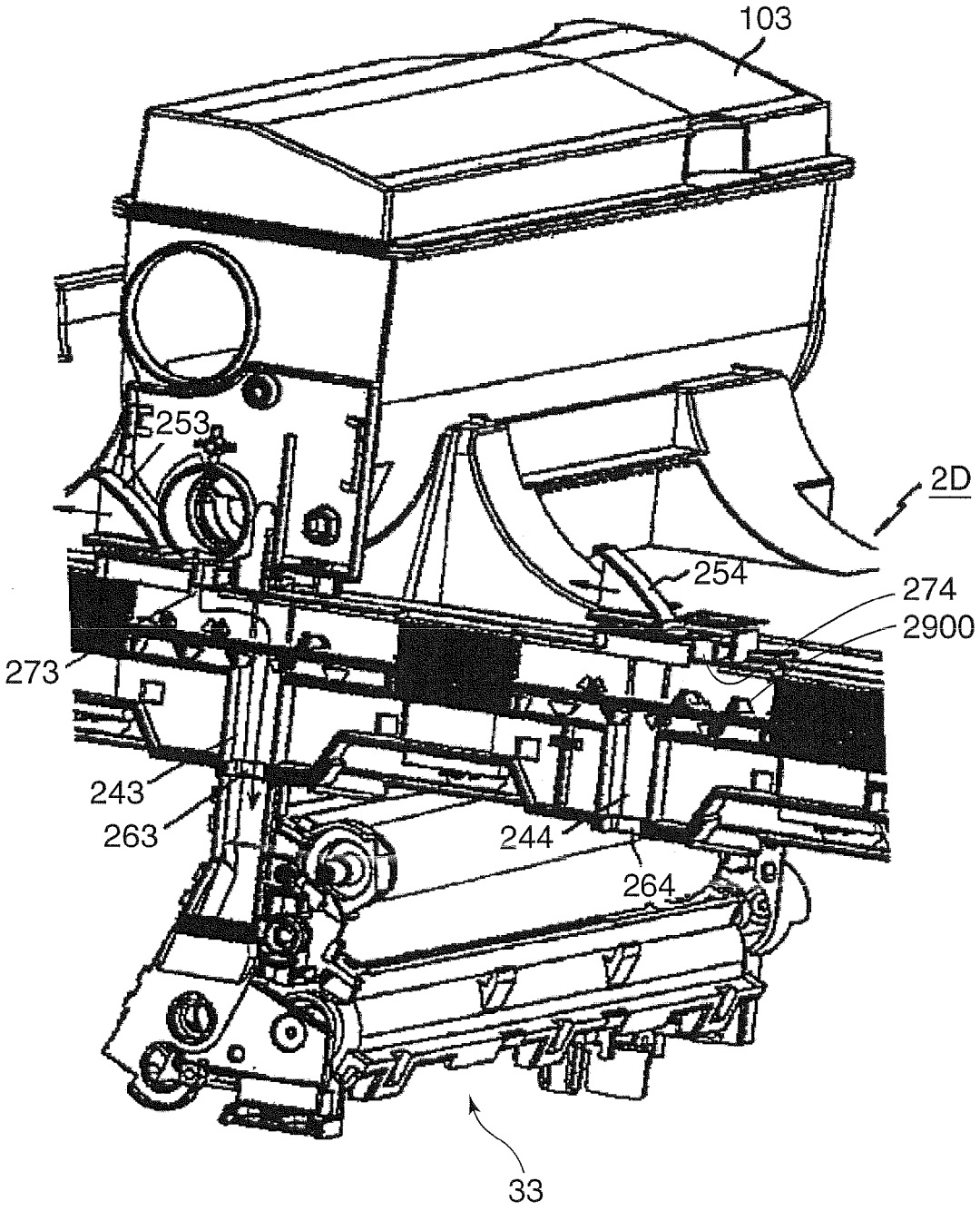
FIG. 26 is a partial perspective view illustrating a mounted toner container.

FIG. 24 is a perspective view of an intermediate transfer unit 2D according to the fifth embodiment. FIG. 25 is a perspective view illustrating a single toner container 103 and a single developing device 33 connected to the intermediate transfer unit 2D. FIG. 26 is a partially cutaway perspective view illustrating the toner container 103.

The fifth embodiment focuses on the shutter members 251, 252, 253, and 254 (hereinafter referred to as "inlet shutters 251, 252, 253, and 254" in this embodiment) for opening/closing the toner inlet ports 271, 272, 273, and 274 as described in the first embodiment (for example, in FIG. 6), and an outlet shutter 50 for opening/closing the toner outlet ports 261, 262, 263, and 264. The structures other than those shutters have already been described in the first embodiment, such that the explanation thereof is omitted or simplified below.

A top surface of the housing 24 of the intermediate transfer unit 2D is provided with mounting sections 20*a*, 20*b*, 20*c*, 20*d* for mounting the toner containers 101, 102, 103, and 104. Also, there are provided inlet shutters 251, 252, 253, and 254 for opening/closing the toner inlet ports 271, 272, 273, and 274 by sliding in a horizontally moving direction of the intermediate transfer belt 21 in association with the attachment/detachment operation of the toner containers 101, 102, 103, and 104, at positions corresponding to the mounting sections 20*a*, 20*b*, 20*c*, 20*d*.

Figure 27:
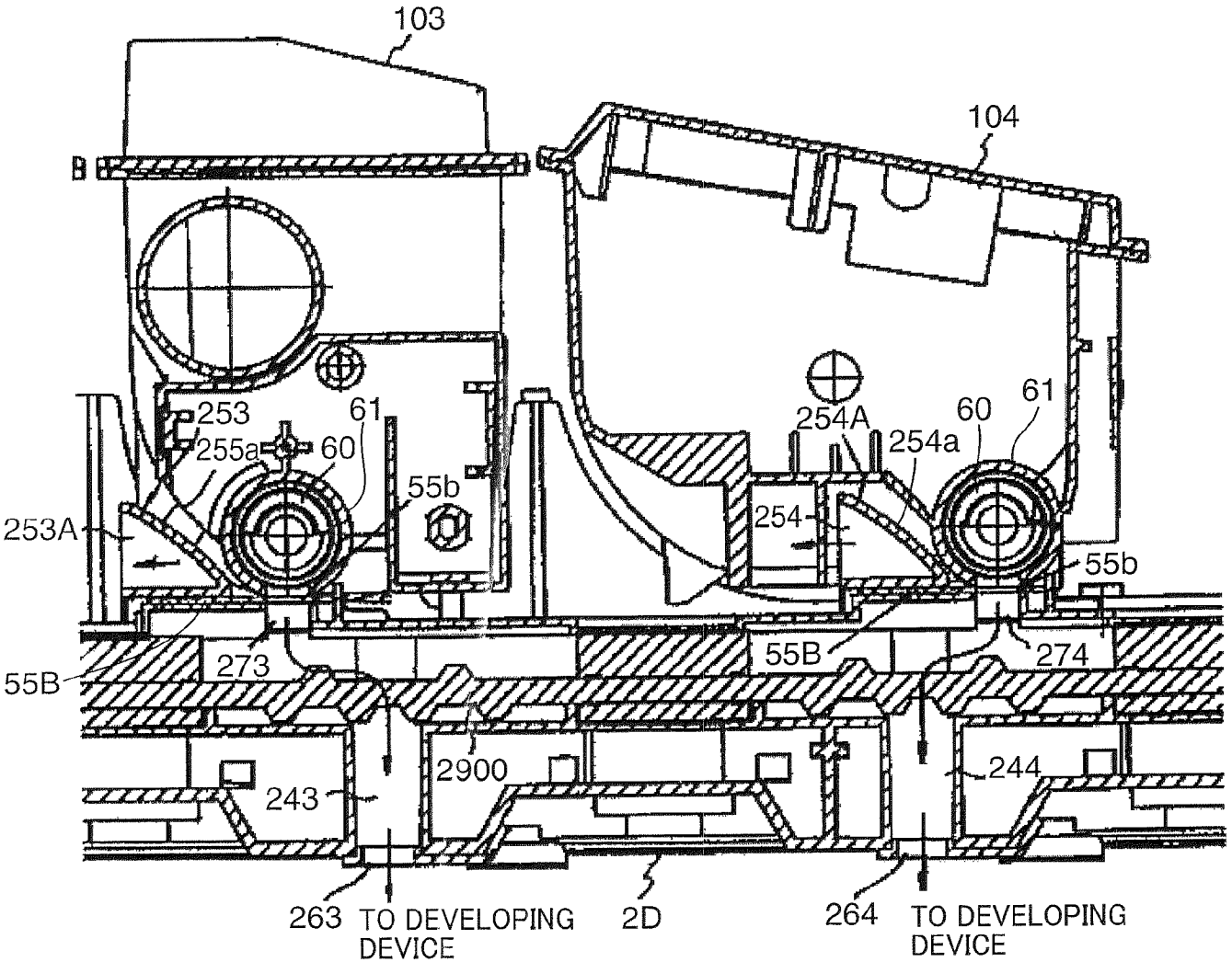
FIG. 27 is a partial cross sectional view illustrating mounted toner containers.
Figure 28:
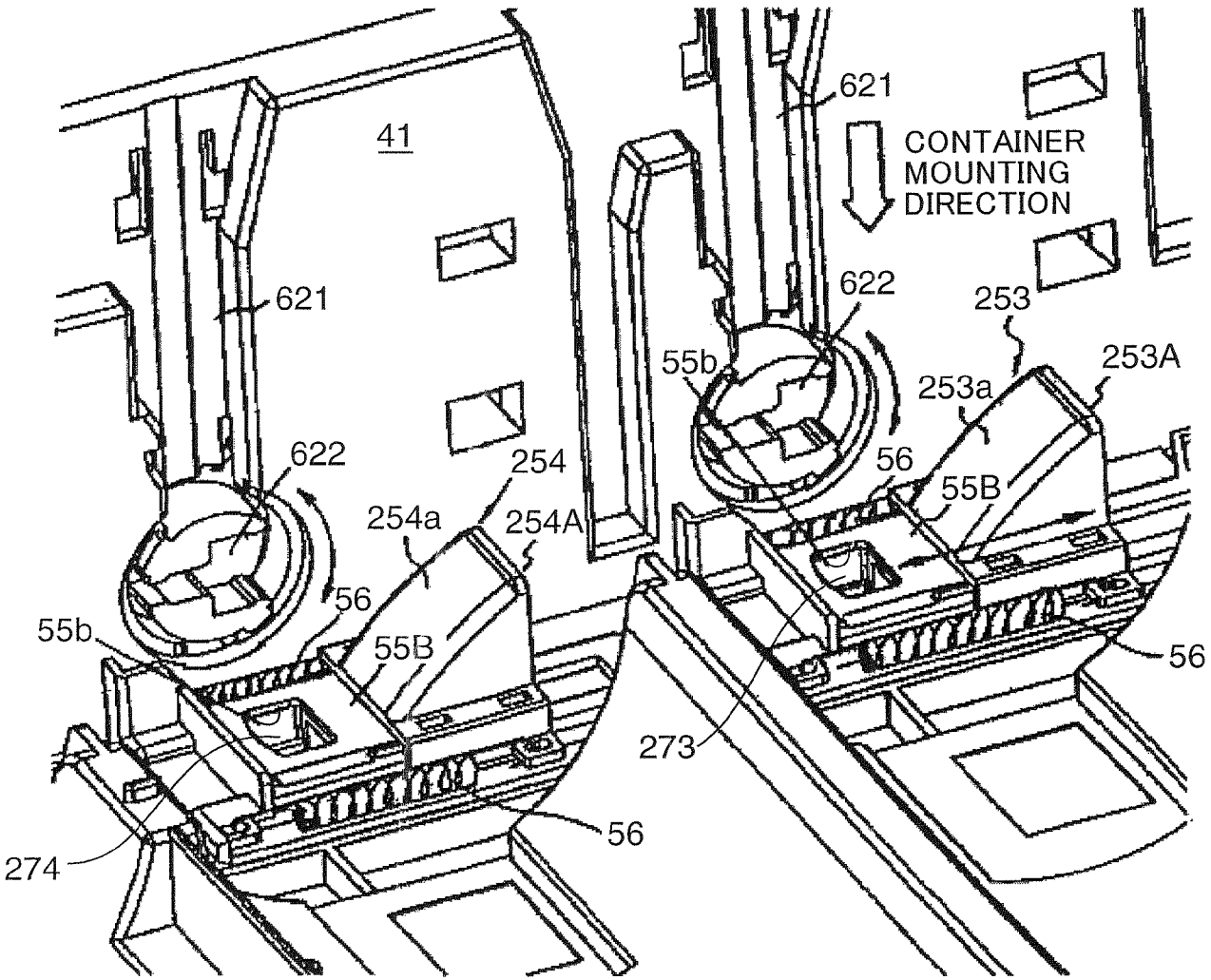
FIG. 28 is a perspective view of an inlet shutter of the intermediate transfer unit according to the fifth embodiment.

FIGS. 27 and 28 illustrate the inlet shutters 251, 252, 253, and 254 into detail. In FIGS. 27 and 28, the inlet shutters 253 and 254 corresponding to the cyan toner container 103 and the black toner container 104 are illustrated. The other inlet shutters 251, 252 also have the same structure.

The inlet shutter 253 includes a cam member 253A and a sealing material 55B. The cam member 253A has an inclined cam surface 253*a* to which a cylindrical section 61 of the toner container 103 engages. The sealing material 55B includes a toner filling opening 55*b* having a shape identical to the toner inlet port 271. The cam member 253A works with the sealing material 55*b* to slide. Similarly, the black inlet shutter 254 includes a cam member 254A comprising a cam surface 254*a* and the sealing material 55B.

The inlet shutters 251, 252, 253, and 254, as shown in FIG. 28, are biased in closing directions which close the toner inlet ports 271, 272, 273, and 274 by means of a pair of tension springs 56. It should be noted that FIG. 28 illustrates the toner container 103, 104 in mounted state i.e. open state of the inlet shutters 253, 254 omitting the toner container 103, 104.

As shown in FIG. 28, an interior surface of the first main body frame 41 (see FIG. 37) is provided with vertical guide grooves 621 in order to guide the toner containers 101, 102, 103, and 104 in a vertical mounting direction (an outlined arrow in FIG. 28). A bottom end of each guide groove 621 is provided with a concave coupling 622. Each coupling 622 engages with a convex coupling 60 (see FIG. 27) provided on each of the toner containers 101, 102, 103, and 104 to couple to each other. The cylindrical section 61 is a member for covering a periphery of the coupling 60 and is molded into one piece with each of the toner containers 101, 102, 103, and 104.

Such a case is exemplified that the cyan toner container 103 is moved downward in the vertical direction along the guide groove 621 of the first main body frame 41 to mount it on the mounting section 20*c* of the intermediate transfer unit 2D (see FIG. 25). In this case, the cylindrical section 61 of the toner container 103 interfaces with the cam surface 253*a* of the cam member 253A of the inlet shutter 253 while the toner container 103 is mounted. Accordingly, the inlet shutter 253 slides to the right in FIG. 28 against a biasing force of the tension spring 56. The toner filling opening 55*b* formed in the sealing material 55B of the inlet shutter 253 corresponds to the toner inlet port 273, such that the toner inlet port 273 automatically opens in association with the attachment operation of the toner container 103.

On the other hand, if the toner container 103 is moved upwardly in the vertical direction along the guide groove 621 of the first main body frame 41 to remove it from the mounting section 50*c*, the interference between the cylindrical section 61 of the toner container 103 and the cam member 253A of the inlet shutter 253 is released. Therefore, the inlet shutter 253 slides to the left in FIG. 28 due to a biasing force of the tension spring 56. Accordingly, the sealing material 55B of the inlet shutter 253 closes the toner inlet port 273. In other words, the toner inlet port 273 is automatically closed in association with a removal operation of the toner container 103. The above is applicable to the other toner containers 101, 102, and 104.

Figure 29A:
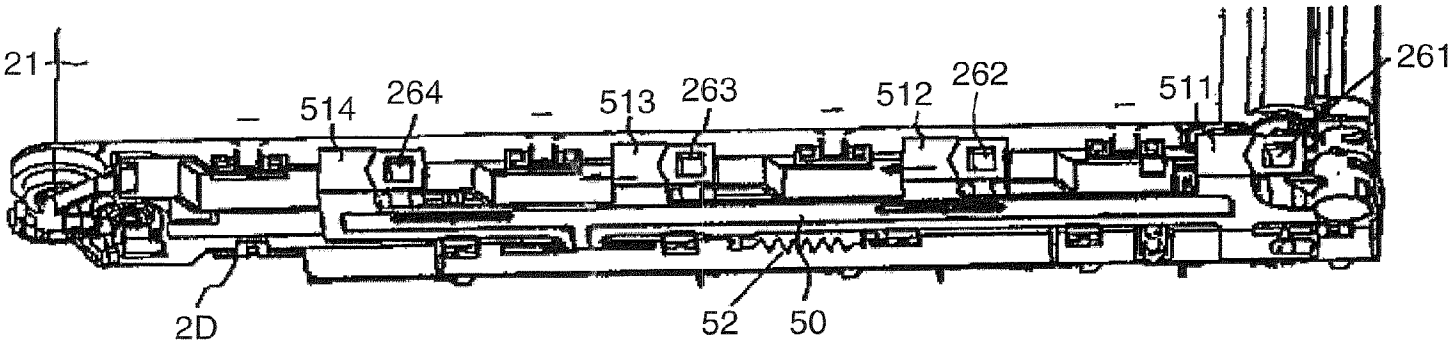
FIG. 29A is a perspective view of the intermediate transfer unit according to the fifth embodiment with toner outlet ports open.
Figure 29B:
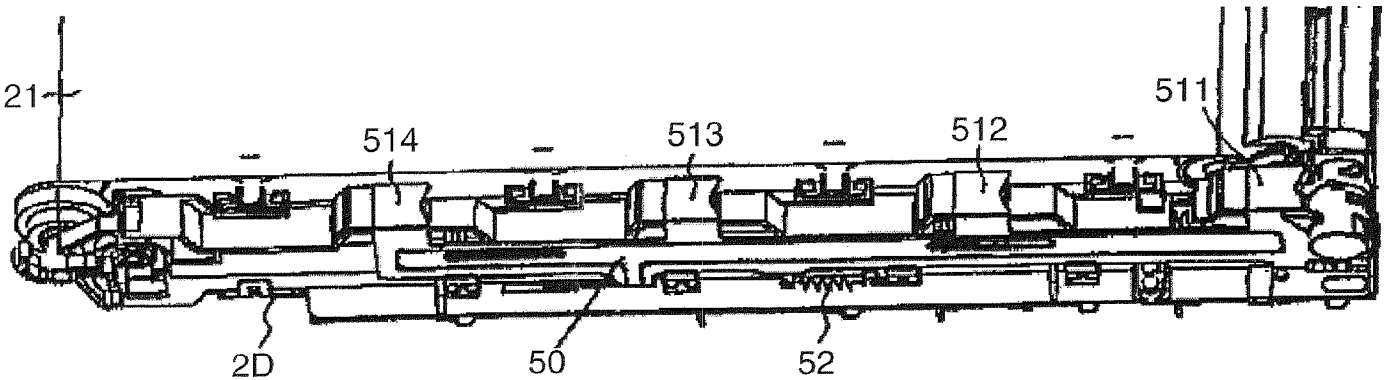
FIG. 29B is a perspective view of the intermediate transfer unit according to the fifth embodiment with toner outlet ports closed.
Figure 30:
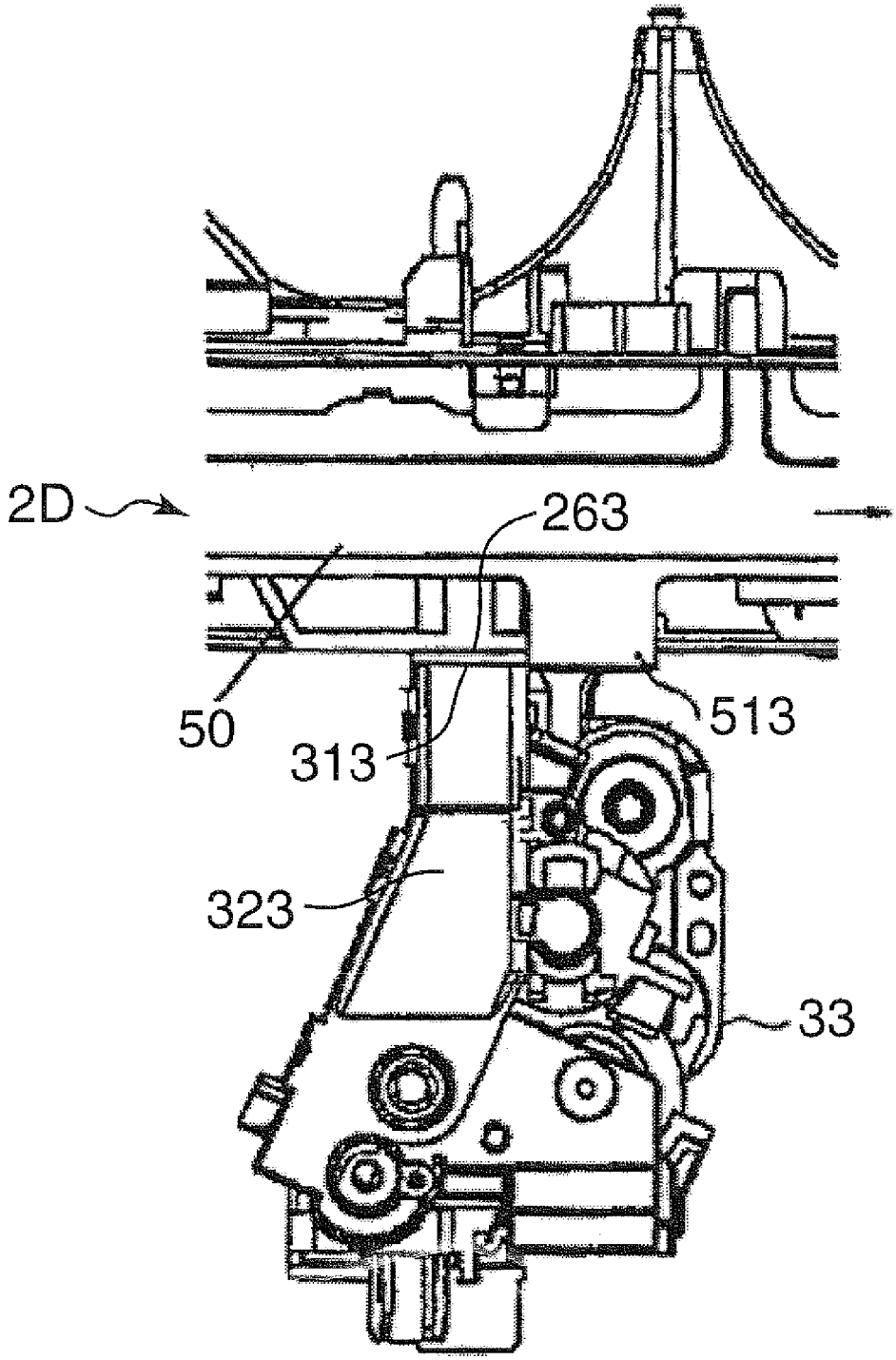
FIG. 30 is a side view illustrating a relation between the outlet shutter of the intermediate transfer unit and a developing device according to the fifth embodiment.
Figure 31:
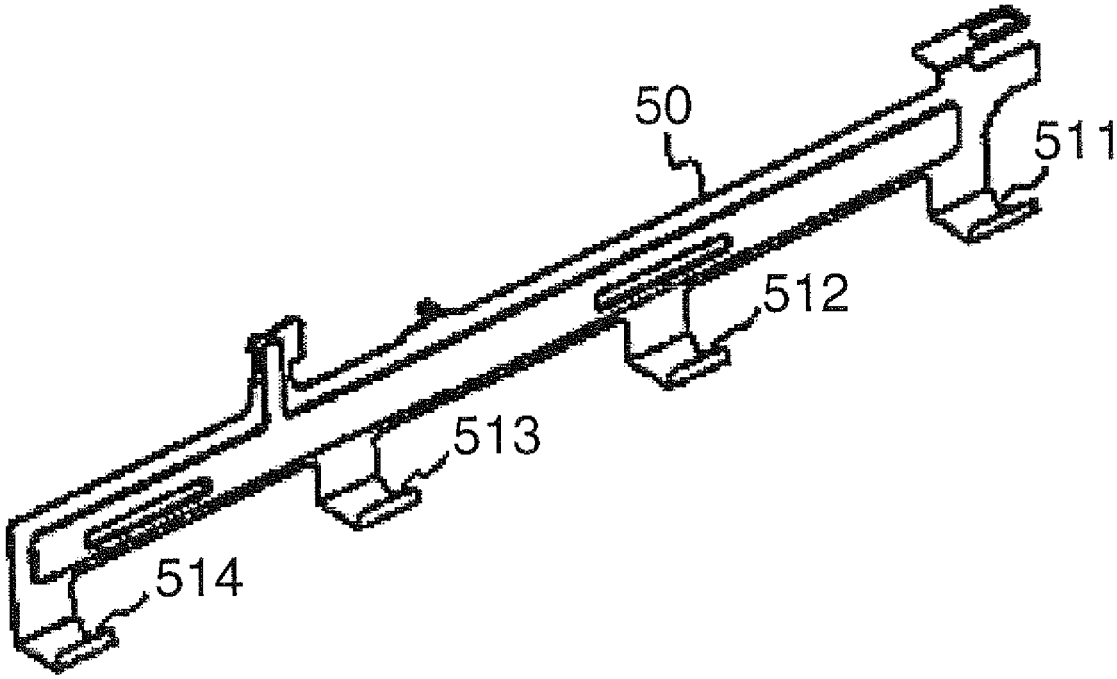
FIG. 31 is a perspective view of the outlet shutter.

The outlet shutter 50 is now described. The present embodiment includes, in addition to the inlet shutters 251, 252, 253, and 254, the outlet shutter 50 for opening/closing the toner outlet ports 261, 262, 263, and 264 provided on the intermediate transfer unit 2D. FIG. 29A is a perspective view illustrating open toner outlet ports 261, 262, 263, and 264; and FIG. 29B is a perspective view illustrating the toner outlet ports 261, 262, 263, and 264 closed respectively by means of the outlet shutter 50. FIG. 30 is a side view illustrating a relation between the outlet shutter 50 and the developing device 33. FIG. 31 is a perspective view of the outlet shutter 50.

The outlet shutter 50 is provided so as to be slidable toward one end surface of the intermediate transfer unit 2D in the width direction (a surface at a side where the inlet shutters 251, 252, 253, and 254 are provided), to open/close all of the four toner outlet ports 261, 262, 263, and 264 at the same time in association with the attachment/detachment operation of the toner containers 101, 102, 103, and 104. This outlet shutter 50 is biased in its closing direction (a direction for closing the toner outlet ports 261, 262, 263, and 264) by means of the tension spring 52.

As shown in FIG. 31, the outlet shutter 50 is formed such that four L-shaped sealing sections 511, 512, 513, 514 for opening/closing the corresponding toner outlet ports 261, 262, 263, and 264 of the intermediate transfer unit 2D are formed into one piece with a frame-like main body. As shown in FIG. 29B, when the toner containers 101, 102, 103, and 104 are not mounted, the four sealing sections 511, 512, 513, 514 close all of the toner outlet ports 261, 262, 263, and 264 of the intermediate transfer unit 2D.

When at least one of the toner containers 101, 102, 103, and 104 is mounted onto the intermediate transfer unit 2D, the outlet shutter 50 slides in an arrow direction in FIG. 30 in association with this mounting operation against the biasing force of the tension spring 52. Accordingly, the four sealing sections 511, 512, 153, 514 of the outlet shutter 50 open all of the toner outlet ports 261, 262, 263, and 264 at the same time and thus the toner outlet ports 261, 262, 263, and 264 and the toner receiving ports 311, 312, 313, and 314 of the developing devices 31, 32, 33, and 34 simultaneously link to each other at the same time.

As described above, the toner inlet ports 271, 272, 273, and 274 of the intermediate transfer unit 2D are opened by means of the inlet shutters 251, 252, 253, and 254 in association with the mounting operation of the toner containers 101, 102, 103, and 104 as well as all the toner outlet ports 261, 262, 263, and 264 are opened by means of the outlet shutter 50 at the same time, resulting in that toner particles can be delivered to each of the developing devices 31, 32, 33, and 34 from the corresponding toner containers 101, 102, 103, and 104 through the intermediate transfer unit 2D.

Also, the toner inlet ports 271, 272, 273, and 274 are closed in association with the removal operation of the corresponding toner containers 101, 102, 103, and 104, and all the toner outlet ports 261, 262, 263, and 264 are closed by the outlet shutter 50 at the same time. Consequently, the toner is reliably prevented from splashing upon attachment/detachment of the toner containers 101, 102, 103, and 104 and thus no such an inconvenience occurs that an inside of the apparatus main body of the color printer X is contaminated by this toner splashing.

Figure 32:
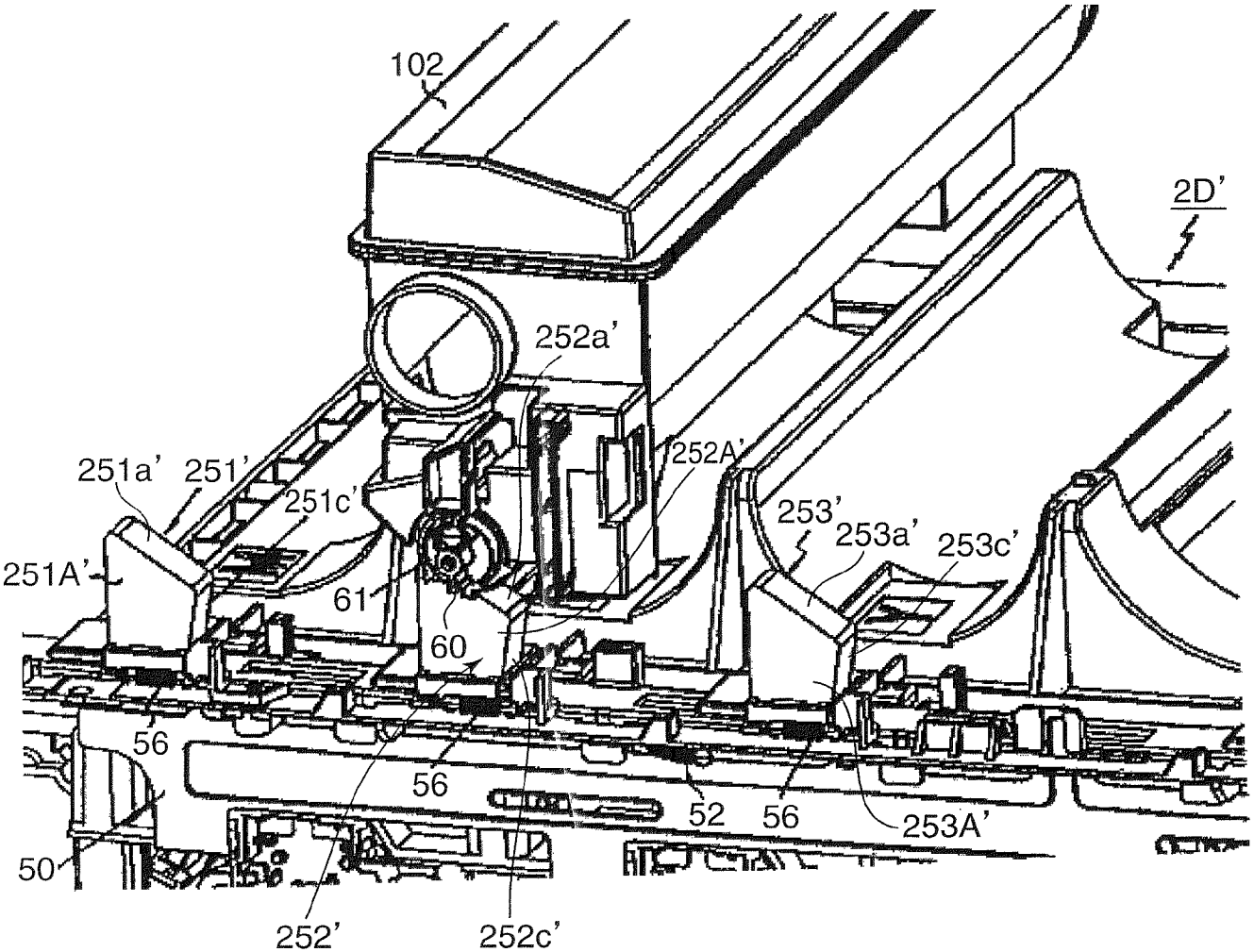
FIGS. 32 and 33 are perspective views illustrating modifications of the inlet shutter.
Figure 33:
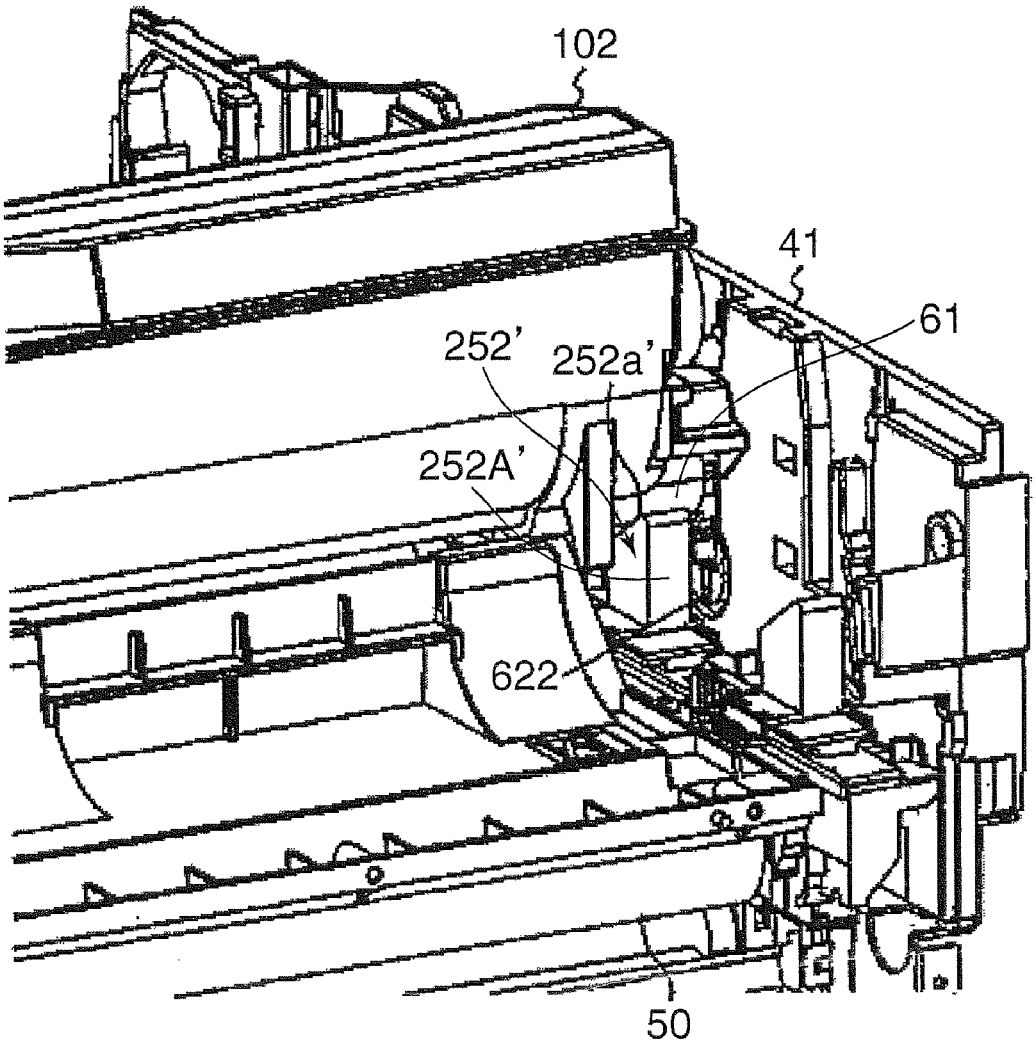
Figure 34:
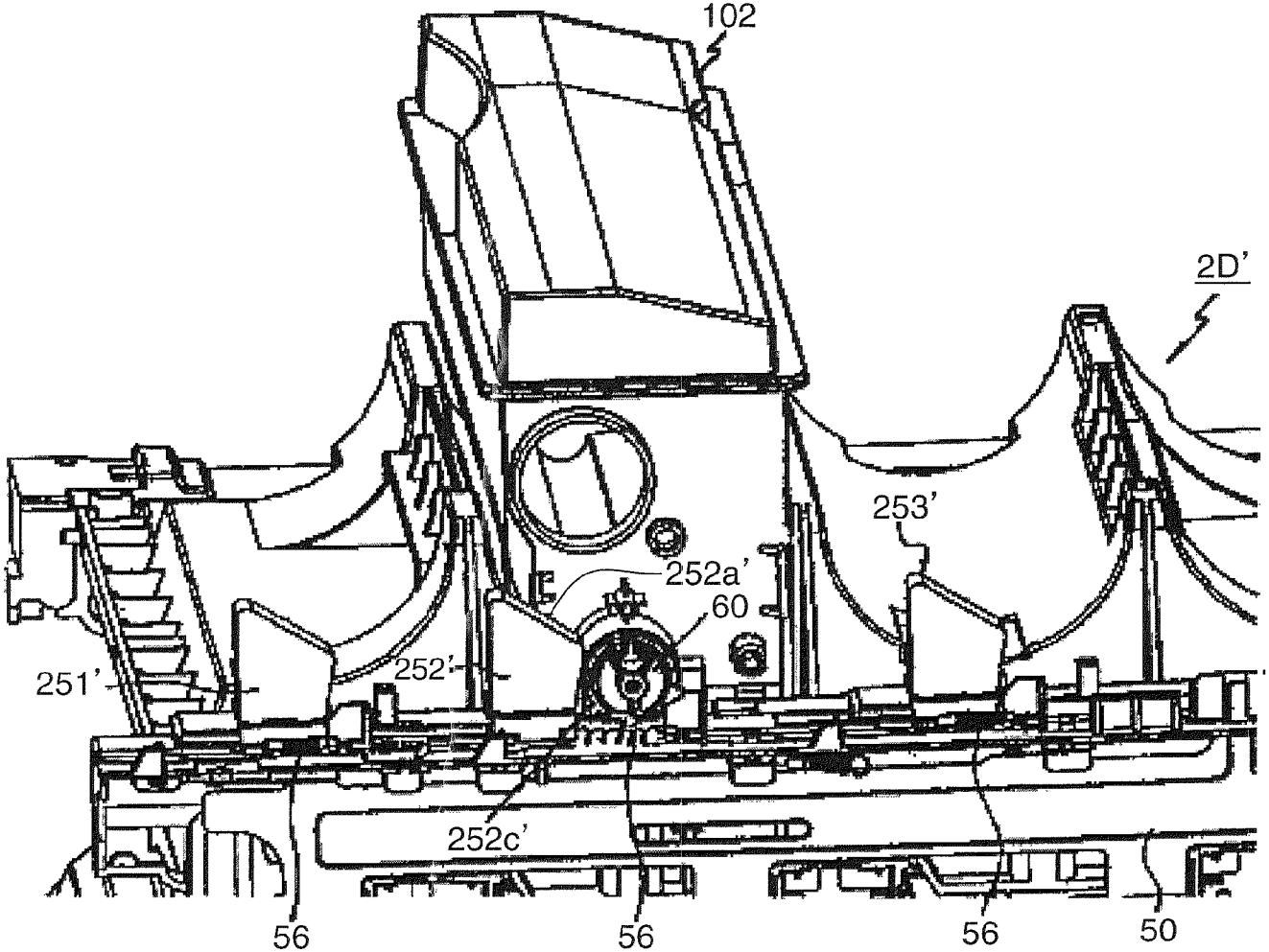
FIG. 34 is a partial perspective view illustrating a mounted toner container.
Figure 35:
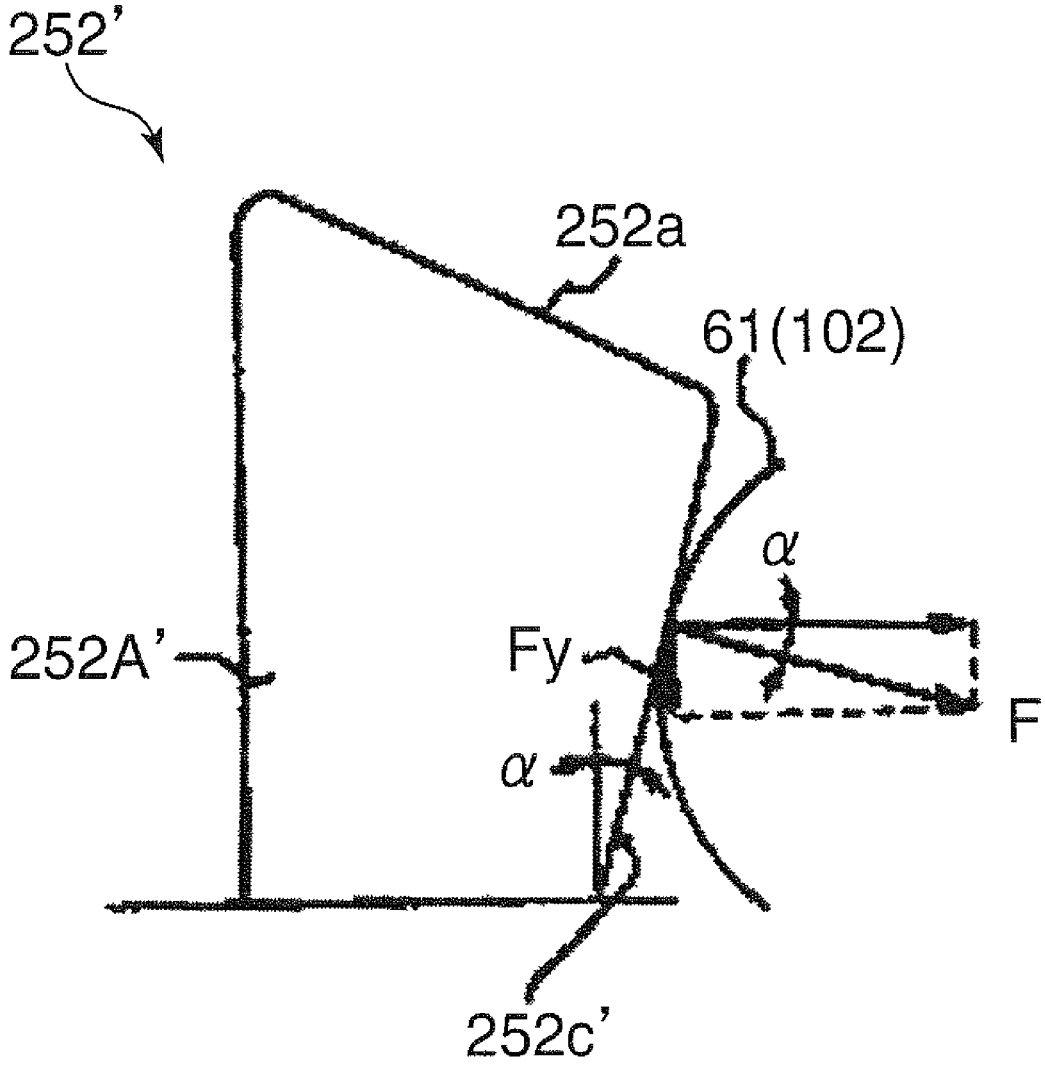
FIG. 35 is graphical illustration of forces on the toner container from the inlet shutter when mounting the toner container.

A modification of the fifth embodiment is now described with reference to FIGS. 32, 33, and 34. FIGS. 32, 33, and 34 are perspective views each illustrating the intermediate transfer unit 2D' comprising the inlet shutter according to the modified embodiment. Here, a single toner container 102 is mounted as an example. FIGS. 32 and 33 are partial perspective views each illustrating a condition where a toner container 102 is temporarily held by the inlet shutter 252'. FIG. 34 is a partial perspective view illustrating the toner container 102 mounted on the intermediate transfer unit 2D'. FIG. 35 is an explanatory diagram illustrating a force the inlet shutter 252' affects the cylindrical section 61 of the toner container 102 at the time of mounting the toner container 102.

The inlet shutter 252' according to the modified embodiment has a flat inclined surface of a cam surface 252*a'* on an upper surface of a cam member 252A' and thereby the toner container 102 can be temporarily held at a position higher than its mounting position by the cam surface 252*a'*. Also, the inlet shutter 252' has a fitting surface 252*c'* which inclines downward by a predetermined angle from the lowermost portion of the cam surface 252*a'*. The inlet shutter 252' is biased to a closing side by the tension spring 56. The other inlet shutters 251' and 253' also include the cam members

251A' and 253A', the cam surfaces 251*a*' and 253*a*', and the fitting surfaces 251*c*' and 253*c*'.

With the above described structure, when the toner container 102 is mounted, the toner container 102 is pressed in its mounting direction (vertically downward) by a perpendicular component force Fy of a biasing force F (=F sin α: α is an inclined angle of the fitting surface 252*c*') which affects the toner container 102 (cylindrical section 61) through the fitting surface 252*c*' of the inlet shutter 252'.

According to the modified embodiment, since the toner container 102 can be temporarily held at the position higher than its mounting position by the cam surface 252*a*' of the inlet shutter 252', such a problem can be avoided that the claws of the couplings 60 and 622 are damaged due to mismatch between the convex coupling 60 of the toner container 102 and the concave coupling 622 at a side of the apparatus main body (see FIG. 28).

As shown in FIG. 35, when the toner container 102 is mounted, the toner container 102 is pressed in its mounting direction by the perpendicular component force Fy of the biasing force F affecting the toner container 102 through the fitting surface 252*c*' of the inlet shutter 252'. Accordingly, the toner container 102 is securely mounted and thus is prevented from its dropping out. The other toner containers 101, 103, and 104 also has the same structure as described above.

Sixth Embodiment

Figure 36:
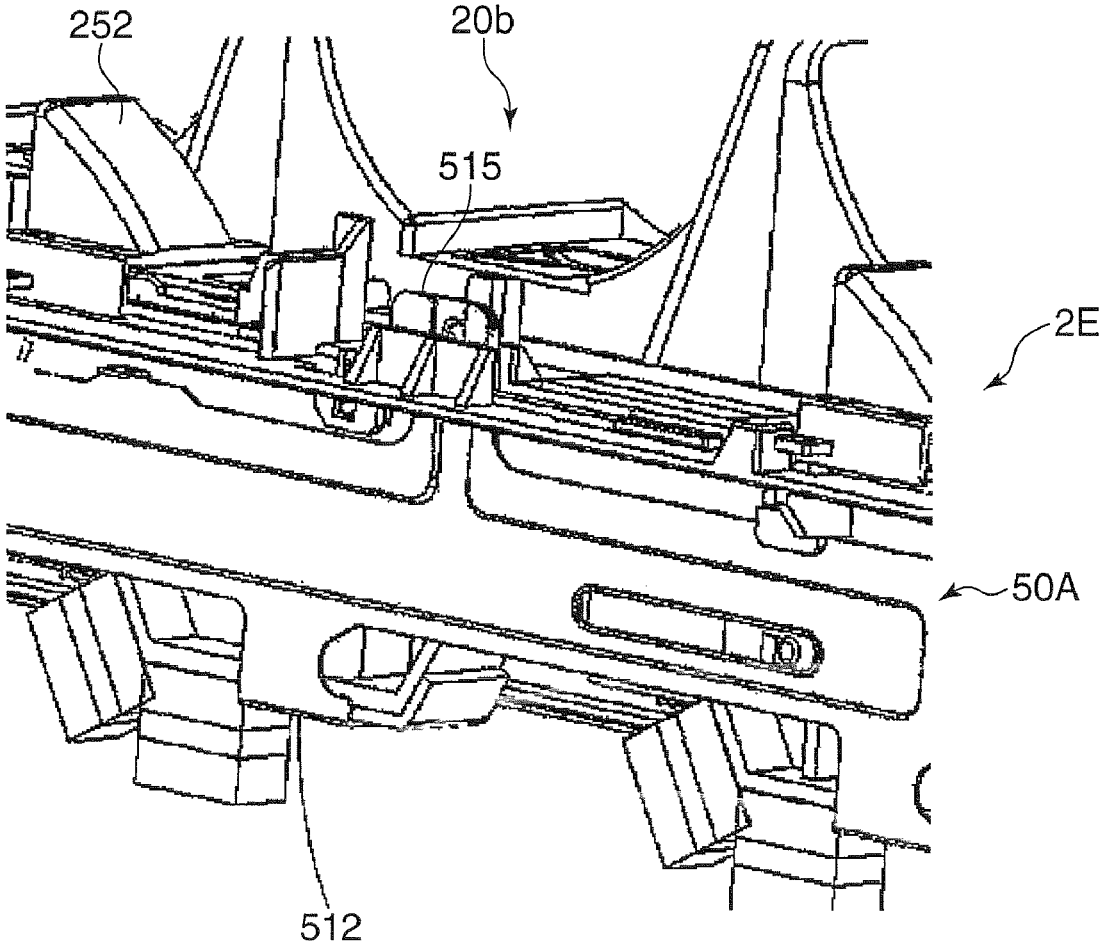
FIG. 36 is a partial perspective view of an intermediate transfer unit according to a sixth embodiment.
Figure 37:
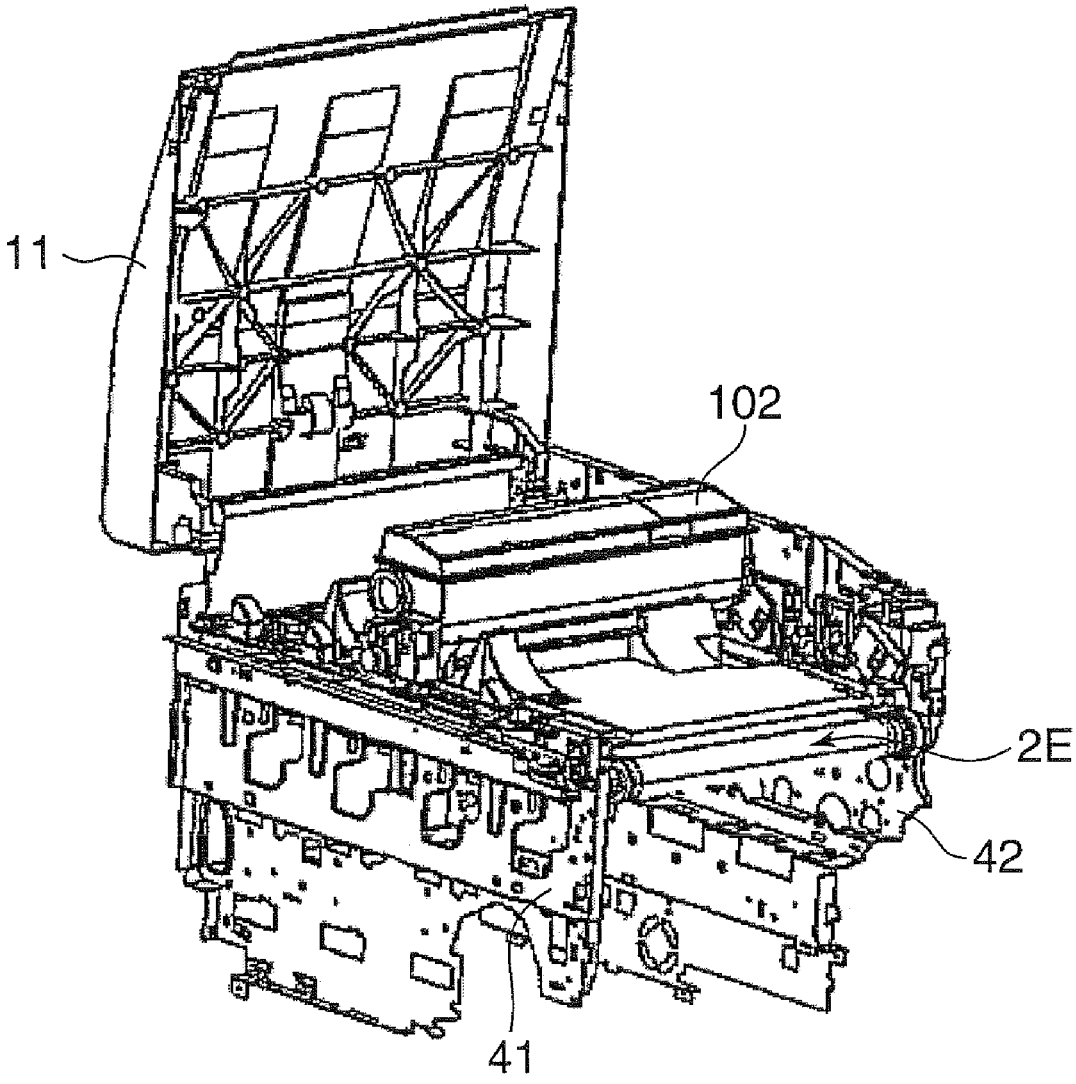
FIG. 37 is a general perspective view illustrating a mounted toner container.

A sixth embodiment is a modification of the outlet shutter 50 as described in the fifth embodiment. FIG. 36 is a partial perspective view illustrating an intermediate transfer unit 2E with the outlet shutter 50A according to the modification. FIG. 37 is an entire perspective view illustrating a mounting condition of a single toner container 102. FIG. 37 illustrates a top cover 11 of the color printer X in FIG. 1, and a first main body frame 41 and a second main body frame 42 which are arranged at both ends of the intermediate transfer unit 2E in its width direction within the housing 10 to hold the intermediate transfer unit 2E or the like.

FIG. 36 illustrates an enlarged view of an area around the mounting section 20*b* to which the toner container 102 is to be mounted. As shown in FIG. 36, the outlet shutter 50A has an interfering section 515 projecting from a top edge of the outlet shutter 50A. The sixth embodiment has a structure identical to the fifth embodiment in that it has the four L-shaped sealing sections 511, 512, 513, and 514 (only the sealing section 512 is shown here) and it is biased to the closing direction by means of the tension springs 52.

The outlet shutter 50A, as has been described above with reference to FIGS. 29A and 29B, is slidable between a closed position (first position) where the four sealing sections 511, 512, 513, and 514 close all of the toner outlet ports 261, 262, 263, and 264, and an open position (second position) where the toner outlet ports 261, 262, 263, and 264 are open. The interfering section 515 is provided on the outlet shutter 50A in such a positional relation that it interferes with the body of the toner container 102 when the outlet shutter 50A is in the closed position, while it does not interfere with the body of the toner container 102 when the outlet shutter 50A is in the open position.

Figure 38:
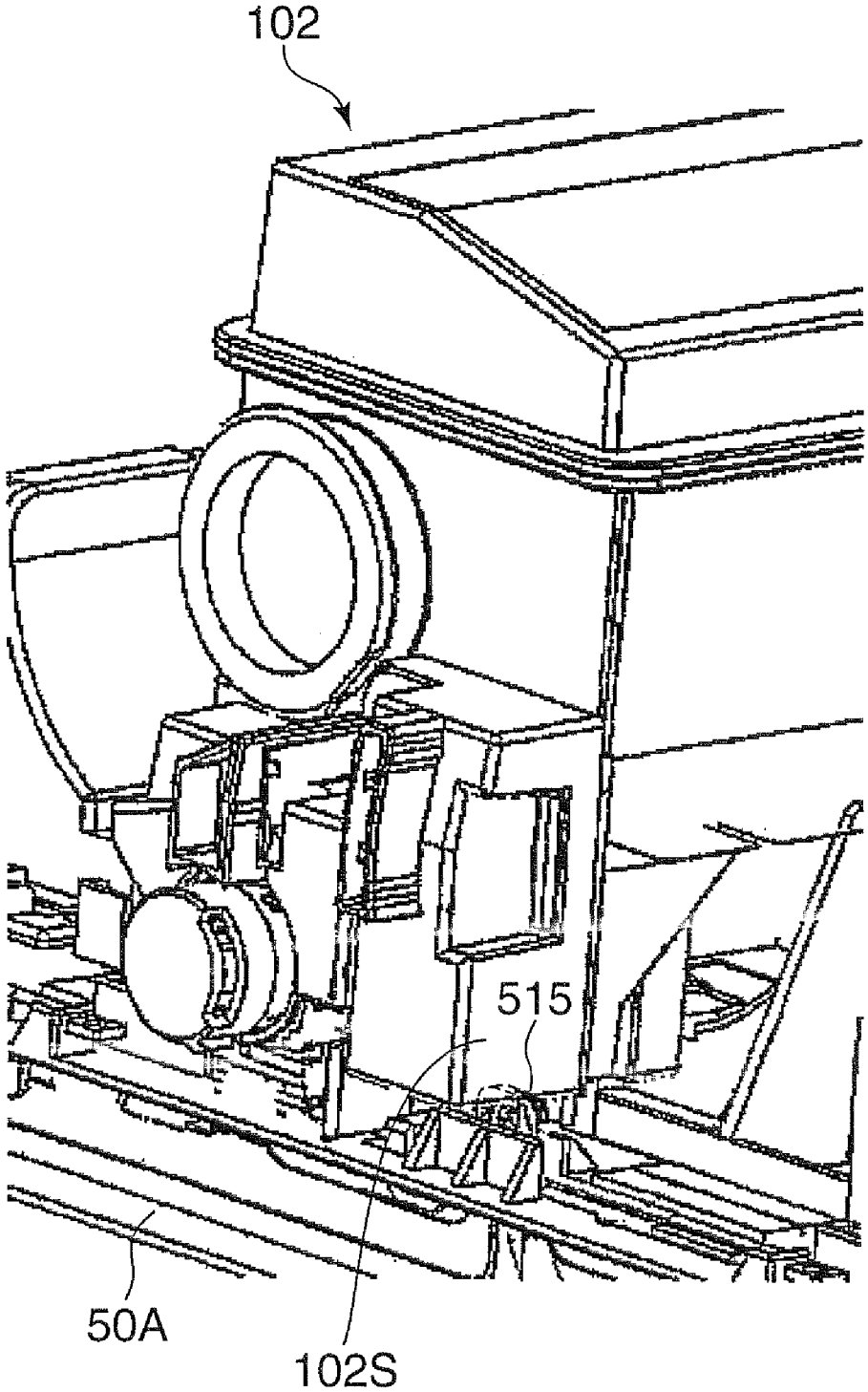
FIG. 38 is a partial perspective view illustrating a mounted toner container wherein the toner container interferes with the outlet shutter.
Figure 39:
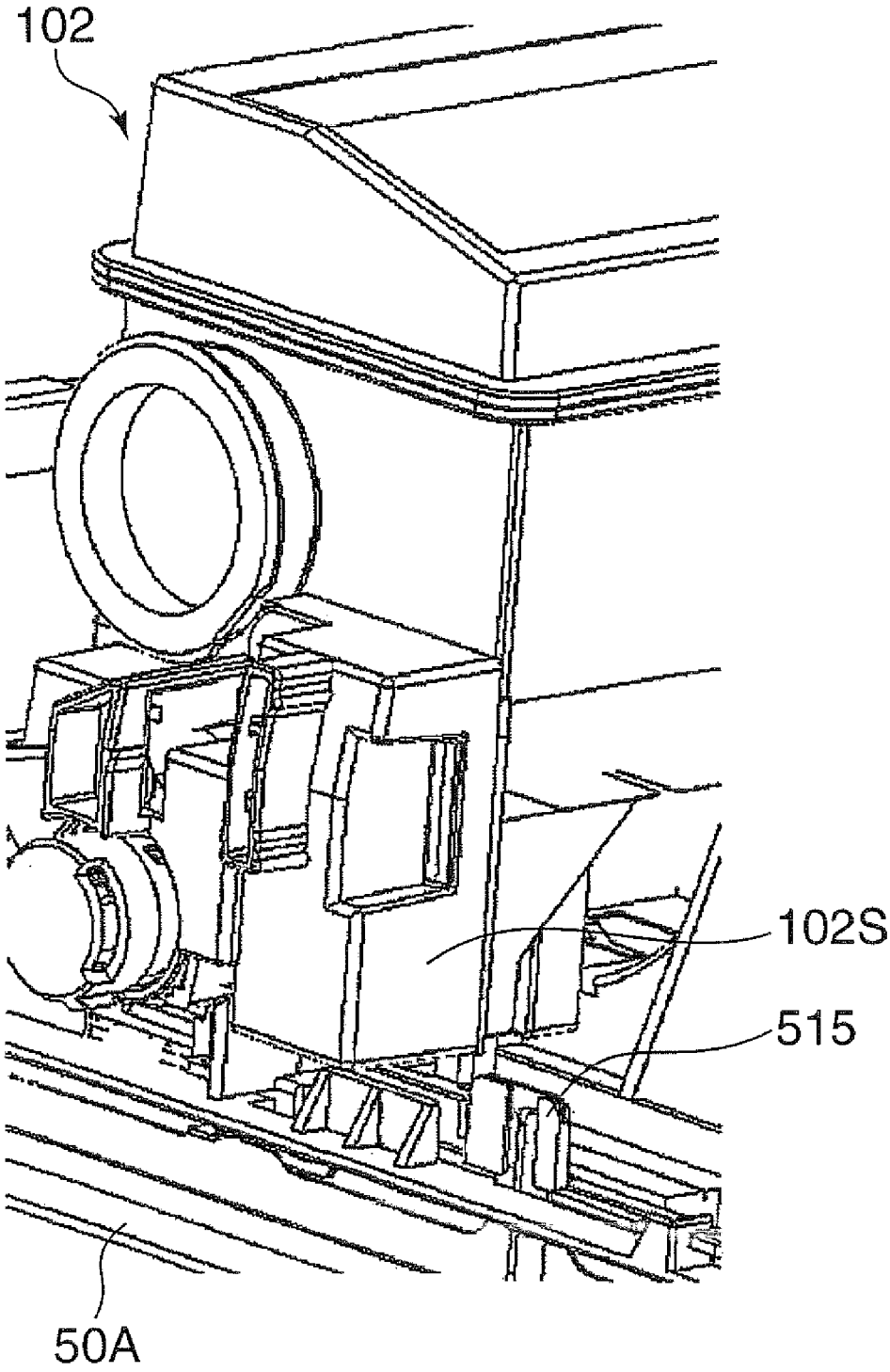
FIG. 39 is a partial perspective view illustrating amounted toner container wherein the toner container does not interfere with the outlet shutter.

FIG. 38 is a partial perspective view illustrating a mounting condition of the toner container 102 where the toner container interferes with the interfering section 515 of the outlet shutter 50A, while FIG. 39 illustrates the toner container 102 not interfering with the interfering section 515.

FIG. 38 illustrates the outlet shutter 50A in the closed position, and thus, if an operator tries to install the toner container 102, a bottom surface of the side cover 102S of the toner container 102 interferes with the interfering section 515. Therefore, the toner container 102 would not be arranged within a predetermined mounting position, but is arranged in a condition it is slightly raised upward by the interfering section 515. In other words, the toner container 102 can not be mounted onto the intermediate transfer unit 2E. In this case, the top cover 11 interferes with the toner container 102 due to a raised position of the toner container 102, preventing complete closure.

On the other hand, FIG. 39 illustrates the outlet shutter 50A sliding to be arranged in an open position. In this case, the interfering section 515 retracts to a position where it does not interfere with a side surface cover 102S of the toner container 102, and thus the operator can house the toner container 102 at a predetermined mounting position. Also, the operator can completely close the top cover 11.

According to the present embodiment, when the intermediate transfer unit 2E is assembled with the main body frames 41, 42, the operator can easily recognize that the outlet shutter 50A is in a closed position, i.e., a condition of poor opening of the toner outlet ports 261, 262, 263, and 264. Therefore, the toner supply path can always be secured.

An image forming apparatus according to one aspect of the present invention comprises:

a plurality of image carriers for carrying the developed images;

a plurality of developer containers for containing the developer, each developer container having a developer supply port;

a plurality of developing devices provided beneath the corresponding each of developer containers, each developing device having a developer receiving port; and an intermediate transfer unit arranged between the developer containers and the developing devices;

wherein the intermediate transfer unit includes:

an intermediate transfer unit for secondarily transferring primarily transferred developed images from the plurality of image carriers onto a sheet;

an intermediate transfer unit driving mechanism for driving the intermediate transfer unit; and a housing for supporting the intermediate transfer unit driving mechanism, the housing comprising at one end thereof a plurality of developer inlet ports positionally corresponding to the developer supply ports respectively, a plurality of developer outlet ports positionally corresponding to the developer receiving ports respectively, and a plurality of developer supply paths connecting between the developer outlet ports and the developer inlet ports, respectively.

In the image forming apparatus with such a structure, developer can be supplied from each of the developer containers through the corresponding developer supply paths formed at one end of the housing of the intermediate transfer unit to each of the developing devices. Therefore, there is no need to provide pipes or the like for supplying the developer detouring around the housing of the intermediate transfer unit as it has been conventionally done. As such, a lateral width of the image forming apparatus can be reduced and thus downsizing of the image forming apparatus can be realized. Also, since the intermediate transfer unit has the developer supply paths, productivity and ease of maintenance can be enhanced comparing to the conventional case wherein the pipes and the like are connected to each other.

In the above structure, at least one of the developer supply paths may have a horizontal path formed substantially in a horizontal direction and a vertical path formed substantially in a vertical direction. With such a structure, the horizontal path contributes flexibly to accept such a case that positions of the developer supply ports misalign with the positions of the developer receiving ports. Further, the developer can be conveyed by means of gravity within the vertical path.

In this case, it is desirable that an additional developer conveyor mechanism for conveying the developer conveys the developer in the horizontal direction within the horizontal paths. Preferably, this developer conveyor mechanism includes, for example, a screw section provided within the horizontal path and a rotation drive unit for rotationally driving the screw section. With such a structure, developer can be conveyed smoothly within the horizontal path.

It is desirable that the rotation drive unit provides a driving force of the intermediate transfer unit driving mechanism to the screw section to allow the screw section to drive rotatably. According to this structure, a driving source of the intermediate transfer unit can be used, which contributes to reduction of cost and prevention of increasing the number of driving sources, such that the structure is suitable for noise control.

In the above structure, it is desirable that at least two of the plurality of developer supply paths include horizontal paths formed in a substantially horizontal direction and a vertical paths formed in a substantially vertical direction, and the developer conveyor mechanism includes one developer conveying member for conveying the developer in the horizontal direction within each of the at least two horizontal paths.

With the above stated structure, since developer in the horizontal paths is conveyed by a single developer conveying member, the number of parts and the cost therefore can be suppressed.

In this case, it is desirable that the developer conveying member includes has at least two screw sections at a position corresponding to each of the at least two horizontal paths. Also, conveying directions of the developers of the at least two horizontal paths by the screw sections can be opposed to each other.

The above stated structure may further include a developer containing chamber provided on the developing device for temporarily containing the developer to be supplied to the developing device, in which the developer containing chamber may be supplied with the developer from the developer outlet port.

In this case, the developer containing chamber desirably includes a developer receiving unit for receiving the developer dropping out from the developer outlet ports by means of gravity, a developer supply unit for supplying the developer to the developer receiving ports of the developing devices, the first wall member arranged at one end of the developing device in its longitudinal direction, and the second wall member which is detachable from the first wall member and which creates an enclosed space with the first wall member.

According to this structure, since the developer containing chamber is separable owing to the first and the second wall members, the die for molding the housing of the developing device can be made into an open type, which means that the die is simplified, and the manufacturing cost can be reduced based on a simplification of the manufacturing process.

It is desirable for the above stated structure to further include an elastic member for pressing and securing the developing device against the intermediate transfer unit positioned above the developing device. In this case, the developer receiving port of the developing device is preferably brought into contact with the developer outlet ports of the intermediate transfer unit by a pressing force of the elastic member.

According to this structure, mount positioning accuracy of the developing device with regard to the intermediate transfer unit can be enhanced and the ease of work in attachment/detachment of the intermediate transfer unit becomes better.

The above stated structure may further include coil springs arranged such that they extend in a vertical direction within the vertical paths, in which the vertical paths have the developer outlet ports and are formed into pipe paths in which the developer drops by means of gravity, in which the developer conveyor mechanism includes a rotational shaft arranged within the horizontal paths and a helical blade formed into one piece with the rotational shaft, in which the rotational shaft has a crossing area which crosses and extends over the developer outlet ports, and in which the coil spring is suspended from the crossing area such that the rotational shaft is rotatable freely.

According to this structure, such a problem that the vertical paths are clogged with the developer can be reliably prevented merely by the coil spring suspending from the rotational shaft.

In this case, it is desirable that the rotational shaft has at its crossing area a projection extending outward in a radial direction from a part of an area in the outer peripheral surface of the rotational shaft, and the coil spring has a top end retaining part formed on a top end thereof, in which the top end retaining part encloses the outer periphery of the rotational shaft comprising the projection in its radial direction to be engaged with and suspended from the rotational shaft in a relatively rotational manner while a bottom end of the coil spring is free from the vertical path or the bottom end retaining part formed at a bottom end of the coil spring is retained by the vertical path.

The above stated structure may further include an inlet shutter for opening/closing the developer inlet port, in which the developer containers are detachable to the intermediate transfer unit, and in which the inlet shutter opens/closes the developer inlet port in association with the attachment/detachment operation of the developer containers.

According to this structure, since the developer inlet port opens/closes in association with the attachment/detachment operation of the developer container, developer is reliably prevented from splashing out.

In this case, it is desirable that the structure further comprises a biasing means for biasing the inlet shutter, in which the inlet shutter comprises an inclined surface at a portion contacting the developer containers, in which the biasing member biases the inlet shutter to a closing side, and in which the developer containers are pressed in a predetermined mounting direction thereof upon mounting of the developer containers by a component force of the biasing force affecting the developer containers through the inclined surface.

Further, it is desirable to further comprise an outlet shutter for opening/closing all of the developer outlet ports at one time in association with the attachment/detachment operation of the developer containers. As such, the developer can be reliably prevented from splashing out also at a side of the developer outlet port.

The above structure may comprises an outlet shutter for opening/closing the developer outlet ports, the outlet shutter comprising an interfering section which is changeable of its position between the first position where the developer outlet ports are closed and the second position that the developer outlet ports are open, and which interferes with the developer container when it resides in the first position while which does not interfere with the developer container when it resides in the second position. In this case, it is desirable that the developer container is prevented from being mounted onto the intermediate transfer unit because the interfering section interferes with the developer container.

According to this structure, an operator can readily recognize a poor opening condition of the developer outlet ports when assembling the intermediate transfer unit onto the apparatus main body. Therefore, the developer supply paths can be secured.

An intermediate transfer unit according to another aspect of the present invention is provided between a plurality of developer containers for containing developer and a plurality of developing devices provided beneath the corresponding developer containers, the intermediate transfer unit comprising:

an intermediate transfer unit for secondarily transferring primarily transferred developed images from the plurality of image carriers onto a sheet;

an intermediate transfer unit driving mechanism for driving the intermediate transfer unit; and a housing for supporting the intermediate transfer unit driving mechanism;

wherein the housing comprises at its one end:

a plurality of developer inlet ports positionally corresponding to the developer supply ports of the developer containers, respectively;

a plurality of developer outlet ports positionally corresponding to the developer receiving port of the developing devices respectively; and a plurality of developer supply paths connecting between the developer inlet ports and the developer outlet ports respectively.

According to the intermediate transfer unit, down-sizing of the image forming apparatus can be achieved and productivity and ease of maintenance can be enhanced.

This application is based on patent application Nos. 2007-009206, 2007-009275, 2007-012172, 2007-012091, 2007-182100 and 2007-268604 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a plurality of image carriers for carrying developed images;

a plurality of developer containers for containing a developer, each of the developer containers having a developer supply port;

a plurality of developing devices provided beneath the corresponding developer containers, each of the developing devices having a developer receiving port;

an intermediate device arranged between the developer containers and the developing devices; and a developer conveying path for conveying the developer from the developer supply port to the developer receiving port, the developer conveying path including a plurality of developer inlet ports positionally corresponding to the developer supply ports, respectively, a plurality of developer outlet ports positionally corresponding to the developer receiving ports, respectively, a plurality of developer supply paths for connecting between the developer inlet ports and the developer outlet ports respectively, and at least one of the developer supply paths having a horizontal path formed in a substantially horizontal direction and a vertical path formed in a substantially vertical direction;

a developer conveyor mechanism for conveying the developer, the developer conveyor mechanism including a screw section provided in the horizontal path, and a rotational drive unit for rotationally driving the screw section so that the developer conveyor mechanism conveys the developer in a horizontal direction within the horizontal path; and a driving mechanism for imparting a driving force to the intermediate device, the rotational drive unit transmitting the driving force of the driving mechanism to the screw section to thereby rotatably drive the screw section.

2. The image forming apparatus according to claim 1, further comprising:

a coil spring arranged in such a manner as to extend in a vertical direction within the vertical path, wherein the vertical path includes a pipe path having the developer outlet port to allow the developer to fall by the weight of the developer, the developer conveyor mechanism includes a rotational shaft provided within the horizontal path and a helical blade found integrally with the rotational shaft; and the rotational shaft has a crossing area crossing and extending above the developer outlet port, and the coil spring is suspended from the crossing area so as to be rotatable relative to the rotational shaft.

3. The image forming apparatus according to claim 2, wherein the rotational shaft has a projection in the crossing area, the projection extending outward in a radial direction from a part of an outer surface of the rotational shaft;

the coil spring has a top end retaining part formed at a top end of the coil spring;

the top end retaining part encircles the outside of the rotational shaft including the projection in the radial direction to be relatively rotatably engaged with and suspended from the rotational shaft; and a bottom end of the coil spring is left free from the vertical path, or a bottom end fitting portion formed at the bottom end of the coil spring is engaged with the vertical path.

4. An image forming apparatus comprising:

a plurality of image carriers for carrying developed images;

a plurality of developer containers for containing a developer, each of the developer containers having a developer supply port;

a plurality of developing devices provided beneath the corresponding developer containers, each of the developing devices having a developer receiving port;

an intermediate device arranged between the developer containers and the developing devices;

a developer conveying path for conveying the developer from the developer supply port to the developer receiving port, the developer conveying path including: a plurality of developer inlet ports positionally corresponding to the developer supply ports, respectively, a plurality of developer outlet ports positionally corresponding to the developer receiving ports, respectively, a plurality of developer supply paths for connecting between the developer inlet ports and the developer outlet ports respectively, at least two of the developer supply paths including horizontal paths formed in a substantially horizontal direction and vertical paths formed in a substantially vertical direction; and a developer conveyor mechanism including a single developer conveying member for conveying the developer in the horizontal direction within each of the at least two horizontal paths.

5. The image forming apparatus according to claim 4, wherein the intermediate device is an intermediate transfer unit including an intermediate transfer member for secondarily transferring primarily transferred developed images from the plurality of image carriers onto a sheet.

6. The image forming apparatus according to claim 4, further comprising:

a developer conveyor mechanism for conveying the developer, wherein the developer conveyor mechanism conveys the developer in a horizontal direction within the horizontal path.

7. The image forming apparatus according to claim 6, wherein the developer conveyor mechanism includes a screw section provided in the horizontal path, and a rotational drive unit for rotationally driving the screw section.

8. The image forming apparatus according to claim 7, further comprising:

a driving mechanism for imparting a driving force to the intermediate device, wherein the rotational drive unit transmits the driving force of the driving mechanism to the screw section to thereby rotatably drive the screw section.

9. The image forming apparatus according to claim 4, wherein the developer conveying member has a screw section at a position corresponding to each of the at least two horizontal paths.

10. The image forming apparatus according to claim 9, wherein the screw portions convey the developer in different conveyance directions from each other.

* * * * *